US008884940B2

(12) United States Patent
Van Lier et al.

(10) Patent No.: US 8,884,940 B2
(45) Date of Patent: Nov. 11, 2014

(54) CHARGE PUMP FOR PRODUCING DISPLAY DRIVER OUTPUT

(75) Inventors: Wilhelmus Johannes Robertus Van Lier, San Diego, CA (US); Pramod K. Varma, San Diego, CA (US)

(73) Assignee: QUALCOMM MEMS Technologies, Inc., San Diego, CA (US)

( * ) Notice: Subject to any disclaimer, the term of this patent is extended or adjusted under 35 U.S.C. 154(b) by 709 days.

(21) Appl. No.: 12/683,312

(22) Filed: Jan. 6, 2010

(65) Prior Publication Data

US 2011/0164009 A1 Jul. 7, 2011

(51) Int. Cl.
*G09G 3/20* (2006.01)
*G09G 3/34* (2006.01)

(52) U.S. Cl.
CPC ..... *G09G 3/3466* (2013.01); *G09G 2330/028* (2013.01); *G09G 2310/0254* (2013.01); *G09G 2330/021* (2013.01); *G09G 2320/0252* (2013.01)
USPC ..... 345/210

(58) Field of Classification Search
USPC ..... 345/214, 215, 20–212
See application file for complete search history.

(56) References Cited

U.S. PATENT DOCUMENTS

| | | | | |
|---|---|---|---|---|
| 4,954,789 | A | 9/1990 | Sampsell | |
| 5,784,189 | A | 7/1998 | Bozler et al. | |
| 6,040,937 | A | 3/2000 | Miles | |
| 6,327,071 | B1 | 12/2001 | Kimura | |
| 6,574,033 | B1 | 6/2003 | Chui et al. | |
| 6,674,562 | B1 | 1/2004 | Miles et al. | |
| 6,909,413 | B2 | 6/2005 | Nanno et al. | |
| 7,042,643 | B2 | 5/2006 | Miles | |
| 7,061,481 | B2 * | 6/2006 | Tsuchiya | 345/211 |
| 7,123,216 | B1 | 10/2006 | Miles | |
| 7,327,510 | B2 | 2/2008 | Cummings et al. | |
| 7,560,299 | B2 | 7/2009 | Cummings | |
| 7,889,163 | B2 | 2/2011 | Chui et al. | |
| 7,990,604 | B2 | 8/2011 | Lee et al. | |
| 8,194,056 | B2 | 6/2012 | Kothari | |
| 2002/0024711 | A1 | 2/2002 | Miles | |
| 2004/0026757 | A1 | 2/2004 | Crane, Jr. et al. | |

(Continued)

FOREIGN PATENT DOCUMENTS

| | | | |
|---|---|---|---|
| EP | 1640956 | A2 | 3/2006 |
| WO | WO 98/00825 | A1 | 1/1998 |

(Continued)

OTHER PUBLICATIONS

International Search Report and Written Opinion from PCT/US2011/020142, mailed Apr. 18, 2011, in 10 pages.

(Continued)

*Primary Examiner* — Allison W Johnson
(74) *Attorney, Agent, or Firm* — Knobbe, Martens, Olson & Bear, LLP

(57) ABSTRACT

A system for driving an array of display elements includes a supply line, at least one capacitor, a plurality of drive lines and overdrive lines, a plurality of switches and a controller configured to activate and deactivate subsets of the switches in order to selectively couple the at least one capacitor to the drive lines and to the overdrive lines. A method for generating an overdrive voltage includes activating and deactivating a plurality of switches to couple a drive voltage line and/or an overdrive voltage line to at least one capacitor.

8 Claims, 17 Drawing Sheets

(56) References Cited

U.S. PATENT DOCUMENTS

| | | | | |
|---|---|---|---|---|
| 2005/0030268 | A1 | 2/2005 | Zhang et al. | |
| 2005/0122560 | A1 | 6/2005 | Sampsell et al. | |
| 2005/0156923 | A1* | 7/2005 | Nishimura | 345/211 |
| 2006/0012585 | A1* | 1/2006 | Schoofs et al. | 345/204 |
| 2006/0044928 | A1 | 3/2006 | Chui et al. | |
| 2007/0002008 | A1 | 1/2007 | Tam | |
| 2008/0273007 | A1 | 11/2008 | Ng et al. | |
| 2008/0284498 | A1* | 11/2008 | Xu et al. | 327/536 |
| 2008/0291122 | A1* | 11/2008 | Smith et al. | 345/55 |
| 2009/0251404 | A1 | 10/2009 | Hwang et al. | |
| 2010/0085347 | A1 | 4/2010 | Kawagoshi | |
| 2010/0245313 | A1 | 9/2010 | Lewis et al. | |
| 2010/0315021 | A1 | 12/2010 | Lau et al. | |

FOREIGN PATENT DOCUMENTS

| | | | |
|---|---|---|---|
| WO | WO 03/007049 | A1 | 1/2003 |
| WO | WO 03/073151 | | 9/2003 |
| WO | WO 2004/026757 | | 4/2004 |
| WO | WO-2007094911 | A1 | 8/2007 |

OTHER PUBLICATIONS

International Preliminary Report on Patentability dated Jul. 2, 2012 in PCT/US11/02142.

* cited by examiner

| | Column Output Signals | |
|---|---|---|
| | $+V_{bias}$ | $-V_{bias}$ |
| Row Output Signals | 0 | Stable | Stable |
| | $+\Delta V$ | Relax | Actuate |
| | $-\Delta V$ | Actuate | Relax |

CHARGE PUMP FOR PRODUCING DISPLAY DRIVER OUTPUT

BACKGROUND

1. Field of the Invention

This invention is related to methods and systems for driving electromechanical systems such as interferometric modulators.

2. Description of Related Art

Electromechanical systems include devices having electrical and mechanical elements, actuators, transducers, sensors, optical components (e.g., mirrors), and electronics. Electromechanical systems can be manufactured at a variety of scales including, but not limited to, microscales and nanoscales. For example, microelectromechanical systems (MEMS) devices can include structures having sizes ranging from about a micron to hundreds of microns or more. Nanoelectromechanical systems (NEMS) devices can include structures having sizes smaller than a micron including, for example, sizes smaller than several hundred nanometers. Electromechanical elements may be created using deposition, etching, lithography, and/or other micromachining processes that etch away parts of substrates and/or deposited material layers or that add layers to form electrical and electromechanical devices. In the following description, the term MEMS device is used as a general term to refer to electromechanical devices, and is not intended to refer to any particular scale of electromechanical devices unless specifically noted otherwise.

One type of electromechanical systems device is called an interferometric modulator. As used herein, the term interferometric modulator or interferometric light modulator refers to a device that selectively absorbs and/or reflects light using the principles of optical interference. In certain embodiments, an interferometric modulator may comprise a pair of conductive plates, one or both of which may be transparent and/or reflective in whole or part and capable of relative motion upon application of an appropriate electrical signal. In a particular embodiment, one plate may comprise a stationary layer deposited on a substrate and the other plate may comprise a metallic membrane separated from the stationary layer by an air gap. As described herein in more detail, the position of one plate in relation to another can change the optical interference of light incident on the interferometric modulator. Such devices have a wide range of applications, and it would be beneficial in the art to utilize and/or modify the characteristics of these types of devices so that their features can be exploited in improving existing products and creating new products that have not yet been developed.

SUMMARY

In one aspect, a system for driving an array of display elements is provided, the system comprising at least one capacitor, at least one charging supply line, a first overdrive line configured to output a positive overdrive voltage to the array of display elements, a second overdrive line configured to output a negative overdrive voltage to the array of display elements, a first plurality of drive lines, each configured to supply a positive drive voltage to the array of display elements, a second plurality of drive lines, each configured to supply a negative drive voltage to the array of display elements, a first plurality of switches configured to selectively couple the at least one charging supply line to the at least one capacitor, a second plurality of switches, wherein each of the second plurality of switches is configured to selectively couple one of the first plurality of drive lines to the at least one capacitor, a third plurality of switches, wherein each of the third plurality of switches is configured to selectively couple one of the second plurality of drive lines to the at least one capacitor, a fourth plurality of switches configured to selectively couple the at least one capacitor to at least one of the first and second overdrive lines, and a controller configured to activate a first subset of the four pluralities of switches while deactivating a second subset of the four pluralities of switches.

In another aspect, a method of generating an overdrive voltage for driving an array of display elements is provided, the method comprising activating at least one first switch to couple a supply voltage to at least one capacitor, deactivating the at least one first switch, activating at least one second switch to couple a drive voltage line to a first side of the at least one capacitor, and activating at least one third switch to couple an overdrive voltage line to a second side of the at least one capacitor.

In another aspect, a display driver circuit configured to drive a display array with a waveform having a plurality of voltage levels, where a first subset of the plurality of voltages is different from a second subset of the plurality of voltages by a defined amount, the display driver circuit comprising a continuous power supply configured to generate the first subset of said plurality of voltages, and a charge pump having the first subset of plurality of voltages as inputs and the second subset of plurality of voltages as outputs.

In another aspect, a display driver circuit configured to drive a display array with a waveform having a plurality of voltage levels, where a first subset of said plurality of voltages is different from a second subset of said plurality of voltages by a defined amount is provided, the display driver circuit comprising means for generating the first subset of said plurality of voltages, and means for deriving the second subset of plurality of voltages from the first subset of plurality of voltages.

DETAILED DESCRIPTION OF PREFERRED EMBODIMENTS

The following detailed description is directed to certain specific embodiments. However, the teachings herein can be applied in a multitude of different ways. In this description, reference is made to the drawings wherein like parts are designated with like numerals throughout. The embodiments may be implemented in any device that is configured to display an image, whether in motion (e.g., video) or stationary (e.g., still image), and whether textual or pictorial. More particularly, it is contemplated that the embodiments may be implemented in or associated with a variety of electronic devices such as, but not limited to, mobile telephones, wireless devices, personal data assistants (PDAs), hand-held or portable computers, GPS receivers/navigators, cameras, MP3 players, camcorders, game consoles, wrist watches, clocks, calculators, television monitors, flat panel displays, computer monitors, auto displays (e.g., odometer display, etc.), cockpit controls and/or displays, display of camera views (e.g., display of a rear view camera in a vehicle), electronic photographs, electronic billboards or signs, projectors, architectural structures, packaging, and aesthetic structures (e.g., display of images on a piece of jewelry). MEMS devices of similar structure to those described herein can also be used in non-display applications such as in electronic switching devices.

As displays based on electromechanical devices become larger, addressing of the entire display becomes more difficult, and a desired frame rate may be more difficult to achieve. A low voltage drive scheme, in which a given row of electromechanical devices is released before new information is written to the row, and in which the data information is conveyed using a smaller range of voltages, addresses these issues by allowing shorter line times. However, such a drive scheme uses multiple different voltages, which complicates the design of the power supply and requires more power to keep the power supply outputs available for display addressing. Simpler and more power efficient supply circuits are disclosed herein that derive some of the necessary outputs form other outputs at the required times.

Figure 1:
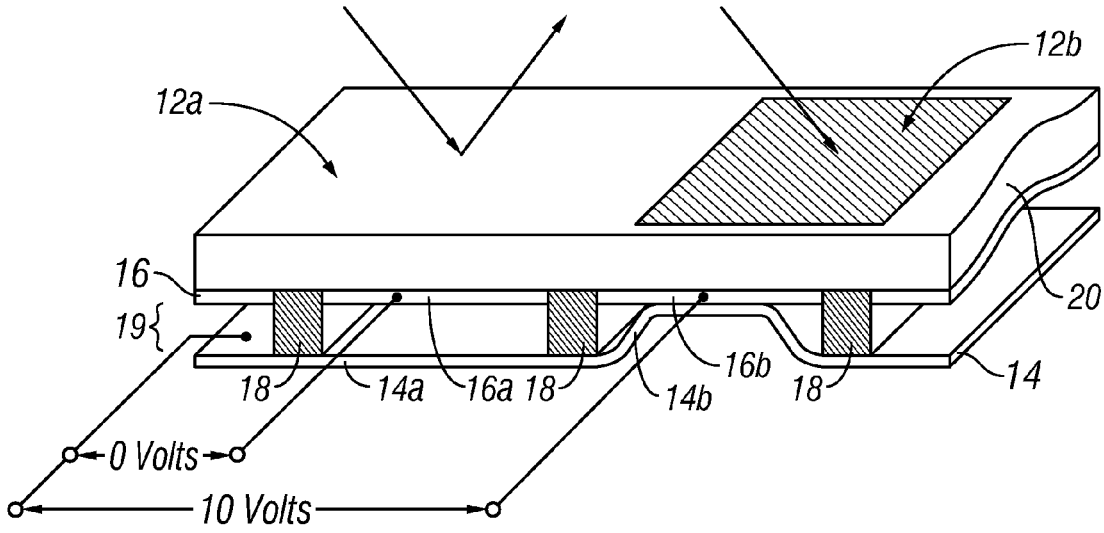
FIG. 1 is an isometric view depicting a portion of one embodiment of an interferometric modulator display in which a movable reflective layer of a first interferometric modulator is in a relaxed position and a movable reflective layer of a second interferometric modulator is in an actuated position.

One interferometric modulator display embodiment comprising an interferometric MEMS display element is illustrated in FIG. 1. In these devices, the pixels are in either a bright or a dark state. In the bright ("relaxed" or "open") state, the display element reflects a large portion of incident visible light to a user. When in the dark ("actuated" or "closed") state, the display element reflects little incident visible light to the user. Depending on the embodiment, the light reflectance properties of the "on" and "off" states may be reversed. MEMS pixels can be configured to reflect predominantly at selected colors, allowing for a color display in addition to black and white.

FIG. 1 is an isometric view depicting two adjacent pixels in a series of pixels of a visual display, wherein each pixel comprises a MEMS interferometric modulator. In some embodiments, an interferometric modulator display comprises a row/column array of these interferometric modulators. Each interferometric modulator includes a pair of reflective layers positioned at a variable and controllable distance from each other to form a resonant optical gap with at least one variable dimension. In one embodiment, one of the reflective layers may be moved between two positions. In the first position, referred to herein as the relaxed position, the movable reflective layer is positioned at a relatively large distance from a fixed partially reflective layer. In the second position, referred to herein as the actuated position, the movable reflective layer is positioned more closely adjacent to the partially reflective layer. Incident light that reflects from the two layers interferes constructively or destructively depending on the position of the movable reflective layer, producing either an overall reflective or non-reflective state for each pixel.

The depicted portion of the pixel array in FIG. 1 includes two adjacent interferometric modulators 12*a* and 12*b*. In the interferometric modulator 12*a* on the left, a movable reflective layer 14*a* is illustrated in a relaxed position at a predetermined distance from an optical stack 16*a*, which includes a partially reflective layer. In the interferometric modulator 12*b* on the right, the movable reflective layer 14*b* is illustrated in an actuated position adjacent to the optical stack 16*b*.

The optical stacks 16*a* and 16*b* (collectively referred to as optical stack 16), as referenced herein, typically comprise several fused layers, which can include an electrode layer, such as indium tin oxide (ITO), a partially reflective layer, such as chromium, and a transparent dielectric. The optical stack 16 is thus electrically conductive, partially transparent and partially reflective, and may be fabricated, for example, by depositing one or more of the above layers onto a transparent substrate 20. The partially reflective layer can be formed from a variety of materials that are partially reflective such as various metals, semiconductors, and dielectrics. The partially reflective layer can be formed of one or more layers of materials, and each of the layers can be formed of a single material or a combination of materials.

In some embodiments, the layers of the optical stack 16 are patterned into parallel strips, and may form row electrodes in a display device as described further below. The movable reflective layers 14*a*, 14*b* may be formed as a series of parallel strips of a deposited metal layer or layers (orthogonal to the row electrodes of 16*a*, 16*b*) to form columns deposited on top of posts 18 and an intervening sacrificial material deposited between the posts 18. When the sacrificial material is etched away, the movable reflective layers 14*a*, 14*b* are separated from the optical stacks 16*a*, 16*b* by a defined gap 19. A highly conductive and reflective material such as aluminum may be used for the reflective layers 14, and these strips may form column electrodes in a display device. Note that FIG. 1 may not be to scale. In some embodiments, the spacing between posts 18 may be on the order of 10-100 um, while the gap 19 may be on the order of <1000 Angstroms.

With no applied voltage, the gap 19 remains between the movable reflective layer 14*a* and optical stack 16*a*, with the movable reflective layer 14*a* in a mechanically relaxed state, as illustrated by the pixel 12*a* in FIG. 1. However, when a potential (voltage) difference is applied to a selected row and column, the capacitor formed at the intersection of the row and column electrodes at the corresponding pixel becomes charged, and electrostatic forces pull the electrodes together. If the voltage is high enough, the movable reflective layer 14 is deformed and is forced against the optical stack 16. A dielectric layer (not illustrated in this Figure) within the optical stack 16 may prevent shorting and control the separation distance between layers 14 and 16, as illustrated by actuated pixel 12*b* on the right in FIG. 1. The behavior is the same regardless of the polarity of the applied potential difference.

FIGS. 2 through 5 illustrate one exemplary process and system for using an array of interferometric modulators in a display application.

Figure 2:
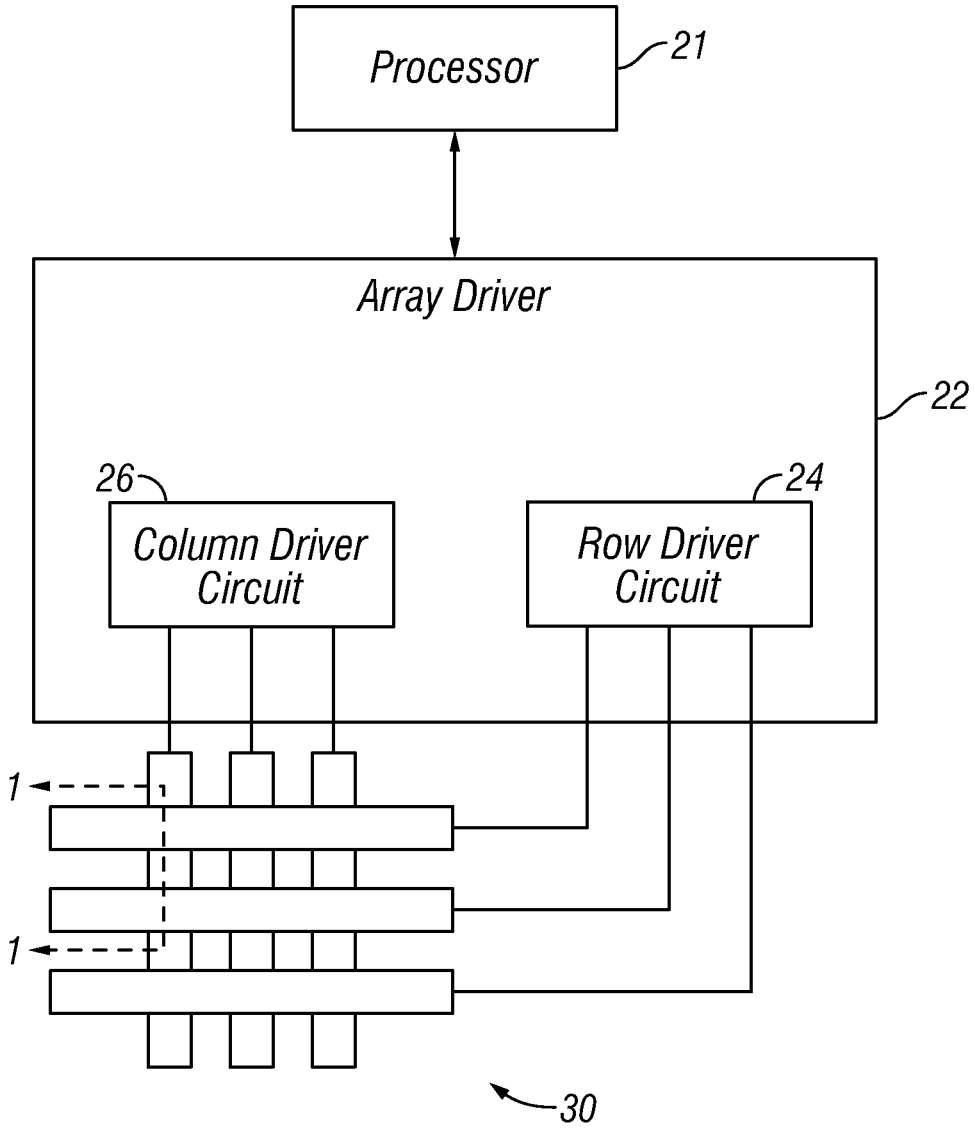
FIG. 2 is a system block diagram illustrating one embodiment of an electronic device incorporating a 3×3 interferometric modulator display.

FIG. 2 is a system block diagram illustrating one embodiment of an electronic device that may incorporate interferometric modulators. The electronic device includes a processor 21 which may be any general purpose single- or multi-chip microprocessor such as an ARM®, Pentium®, 8051, MIPS®, Power PC®, or ALPHA®, or any special purpose microprocessor such as a digital signal processor, microcontroller, or a programmable gate array. As is conventional in the art, the processor 21 may be configured to execute one or more software modules. In addition to executing an operating system, the processor may be configured to execute one or more software applications, including a web browser, a telephone application, an email program, or any other software application.

In one embodiment, the processor 21 is also configured to communicate with an array driver 22. In one embodiment, the array driver 22 includes a row driver circuit 24 and a column driver circuit 26 that provide signals to a display array or panel 30. The row driver circuit and column driver circuit 26 may be generically referred to as a segment driver circuit and a common driver circuit, and either of the row or columns may be used to apply segment voltages and common voltages. Furthermore, the terms "segment" and "common" are used herein merely as labels, and are not intended to convey any particular meaning regarding the configuration of the array beyond that which is discussed herein. In certain embodiments, the common lines extend along the movable electrodes, and the segment lines extend along the fixed electrodes within the optical stack. The cross section of the array illustrated in FIG. 1 is shown by the lines 1-1 in FIG. 2. Note that although FIG. 2 illustrates a 3×3 array of interferometric modulators for the sake of clarity, the display array 30 may contain a very large number of interferometric modulators, and may have a different number of interferometric modulators in rows than in columns (e.g., 300 pixels per row by 190 pixels per column).

Figures 3, 4:
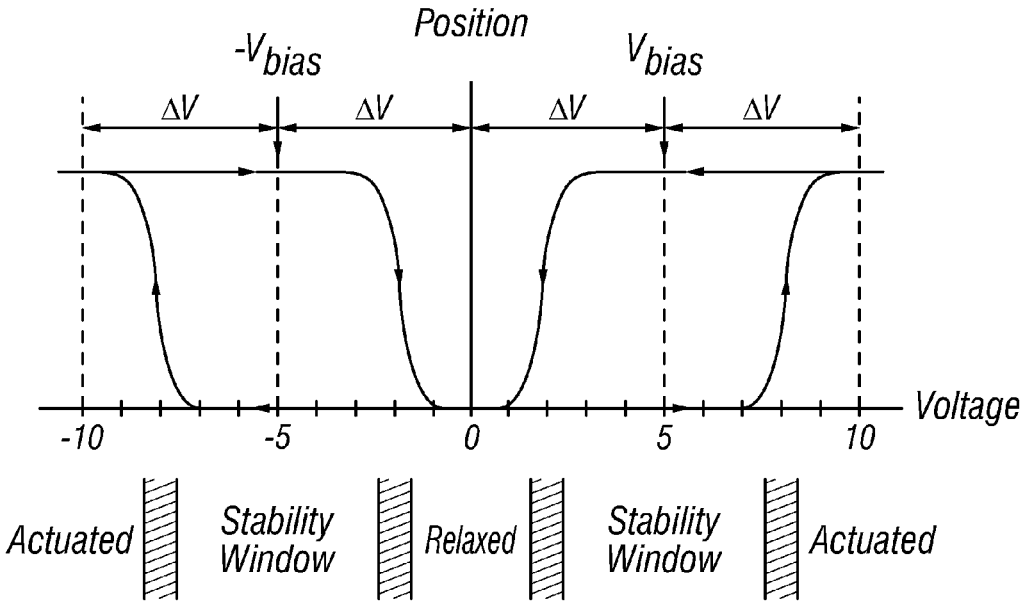
FIG. 3 is a diagram of movable mirror position versus applied voltage for one exemplary embodiment of an interferometric modulator of FIG. 1.
FIG. 4 is an illustration of a set of row and column voltages that may be used to drive an interferometric modulator display using a high voltage drive scheme.

FIG. 3 is a diagram of movable mirror position versus applied voltage for one exemplary embodiment of an interferometric modulator of FIG. 1. For MEMS interferometric modulators, the row/column actuation protocol may take advantage of a hysteresis property of these devices as illustrated in FIG. 3. An interferometric modulator may require, for example, a 10 volt potential difference to cause a movable layer to deform from the relaxed state to the actuated state. However, when the voltage is reduced from that value, the movable layer maintains its state as the voltage drops back below 10 volts. In the exemplary embodiment of FIG. 3, the movable layer does not relax completely until the voltage drops below 2 volts. There is thus a range of voltage, about 3 to 7 V in the example illustrated in FIG. 3, where there exists a window of applied voltage within which the device is stable in either the relaxed or actuated state. This is referred to herein as the "hysteresis window" or "stability window."

In certain embodiments, the actuation protocol may be based on a drive scheme such as that discussed in U.S. Pat. No. 5,835,255. In certain embodiments of such drive schemes, for a display array having the hysteresis characteristics of FIG. 3, the row/column actuation protocol can be designed such that during row strobing, pixels in the strobed row that are to be actuated are exposed to a voltage difference of about 10 volts, and pixels that are to be relaxed are exposed to a voltage difference of close to zero volts. After the strobe, the pixels are exposed to a steady state or bias voltage difference of about 5 volts such that they remain in whatever state the row strobe put them in. After being written, each pixel sees a potential difference within the "stability window", of 3-7 volts in this example. When other lines are addressed by strobing a different row, the voltage across a non-strobed column line may be switched between a value within the positive stability window and a value within the negative stability window, due to changes in the bias voltage applied along the column line to address the strobed row in the desired manner. This feature makes the pixel design illustrated in FIG. 1 stable under the same applied voltage conditions in either an actuated or relaxed pre-existing state. Since each pixel of the interferometric modulator, whether in the actuated or relaxed state, is essentially a capacitor formed by the fixed and moving reflective layers, this stable state can be held at a voltage within the hysteresis window with almost no power dissipation. Essentially no current flows into the pixel if the applied potential is fixed.

As described further below, in certain applications, a frame of an image may be created by sending a set of data signals (each having a certain voltage level) across the set of column electrodes (also referred to as segment electrodes) in accordance with the desired set of actuated pixels in the first row. A row pulse is then applied to a first row electrode (also referred to as a common electrode), actuating the pixels corresponding to the set of data signals. The set of data signals is then changed to correspond to the desired set of actuated pixels in a second row. A pulse is then applied to the second row electrode, actuating the appropriate pixels in the second row in accordance with the data signals. The first row of pixels are unaffected by the second row pulse, and remain in the state they were set to during the first row pulse. This may be repeated for the entire series of rows in a sequential fashion to produce the frame. Generally, the frames are refreshed and/or updated with new image data by continually repeating this process at some desired number of frames per second. A wide variety of protocols for driving row and column electrodes of pixel arrays to produce image frames may be used.

FIGS. 4 and 5 illustrate one possible actuation protocol for such a drive scheme, where the actuation protocol can be used for creating a display frame on the 3×3 array of FIG. 2. FIG. 4 illustrates a possible set of column and row voltage levels that may be used for pixels exhibiting the hysteresis curves of FIG. 3. In the FIG. 4 embodiment, actuating a pixel involves setting the appropriate column to $-V_{bias}$, and the appropriate row to $+\Delta V$, which may correspond to −5 volts and +5 volts respectively Relaxing the pixel is accomplished by setting the appropriate column to $+V_{bias}$, and the appropriate row to the same $+\Delta V$, producing a zero volt potential difference across the pixel. In those rows where the row voltage is held at zero volts, the pixels are stable in whatever state they were originally in, regardless of whether the column is at $+V_{bias}$, or $-V_{bias}$. As is also illustrated in FIG. 4, voltages of opposite polarity than those described above can be used, e.g., actuating a pixel can involve setting the appropriate column to $+V_{bias}$, and the appropriate row to $-\Delta V$. In this embodiment, releasing the pixel is accomplished by setting the appropriate column to $-V_{bias}$, and the appropriate row to the same $-\Delta V$, producing a zero volt potential difference across the pixel.

Figure 5A:
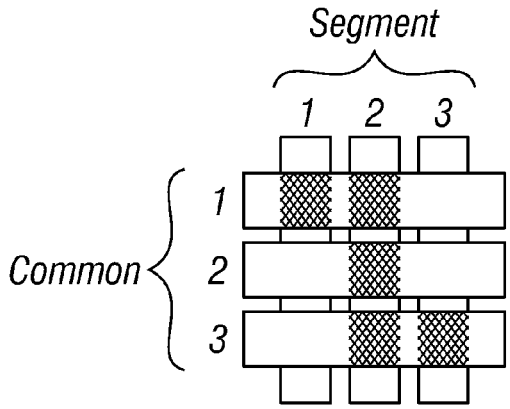
FIGS. 5A and 5B illustrate one exemplary timing diagram for row and column signals that may be used to write a frame of display data to the 3×3 interferometric modulator display of FIG. 2 using one example drive scheme.
Figure 5B:
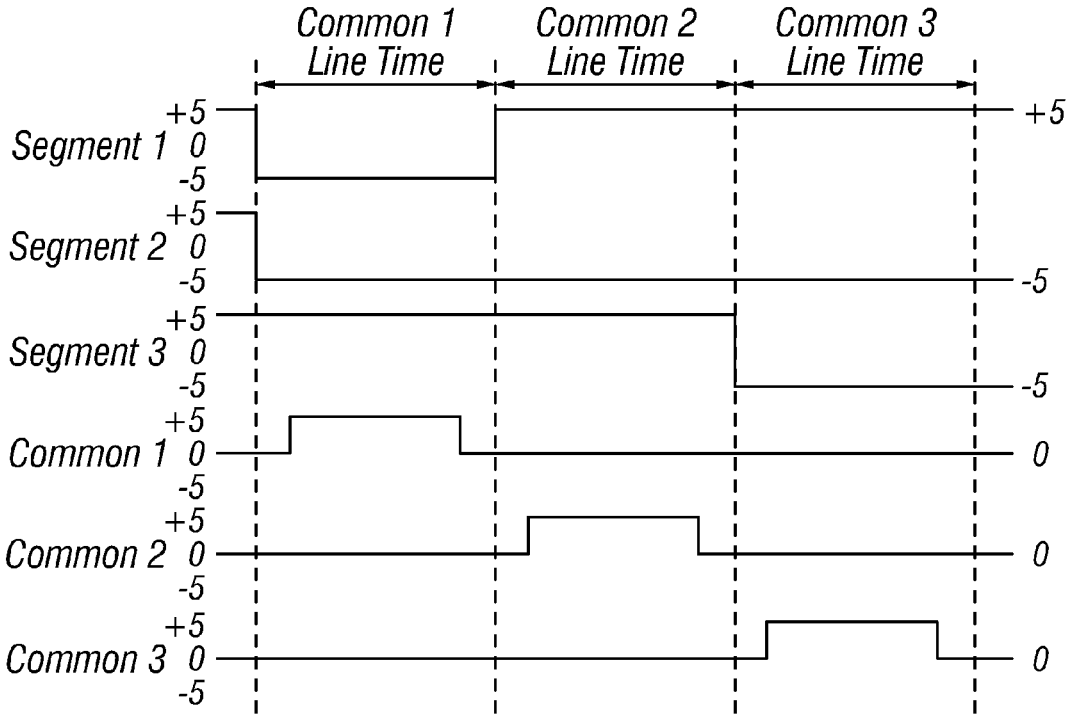

FIG. 5B is a timing diagram showing a series of row and column signals applied to the 3×3 array of FIG. 2 which will result in the display arrangement illustrated in FIG. 5A, where actuated pixels are non-reflective. In FIGS. 5A and 5B, the columns are referred to as segment electrodes, which are the electrodes receiving the image data, and the rows are referred to as common electrodes, which are the electrodes that are sequentially strobed to write each line with the segment data. Prior to writing the frame illustrated in FIG. 5A, the pixels can be in any state, and in this example, all the rows are initially at 0 volts, and all the columns are at +5 volts. With these applied voltages, all pixels are stable in their existing actuated or relaxed states.

In the FIG. 5A frame, pixels (1,1), (1,2), (2,2), (3,2) and (3,3) are actuated. To accomplish this, during a "line time" for row 1, columns 1 and 2 are set to −5 volts, and column 3 is set to +5 volts. This does not change the state of any pixels, because all the pixels remain in the 3-7 volt stability window. Row 1 is then strobed with a pulse that goes from 0, up to 5 volts, and back to zero. This actuates the (1,1) and (1,2) pixels and relaxes the (1,3) pixel. No other pixels in the array are affected. To set row 2 as desired, column 2 is set to −5 volts, and columns 1 and 3 are set to +5 volts. The same strobe applied to row 2 will then actuate pixel (2,2) and relax pixels (2,1) and (2,3). Again, no other pixels of the array are affected. Row 3 is similarly set by setting columns 2 and 3 to −5 volts, and column 1 to +5 volts. The row 3 strobe sets the row 3 pixels as shown in FIG. 5A. After writing the frame, the row potentials are zero, and the column potentials can remain at either +5 or −5 volts, and the display is then stable in the arrangement of FIG. 5A. The same procedure can be employed for arrays of dozens or hundreds of rows and columns. The timing, sequence, and levels of voltages used to perform row and column actuation can be varied widely within the general principles outlined above, and the above example is exemplary only, and any actuation voltage method can be used with the systems and methods described herein.

Figure 6A:
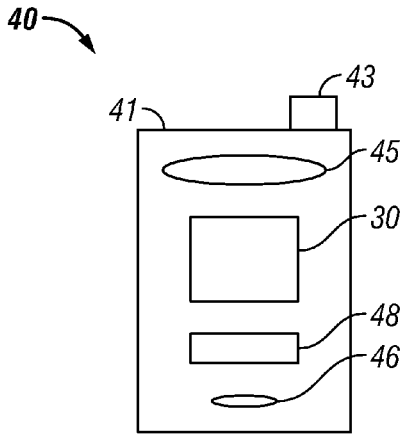
FIGS. 6A and 6B are system block diagrams illustrating an embodiment of a visual display device comprising a plurality of interferometric modulators.
Figure 6B:
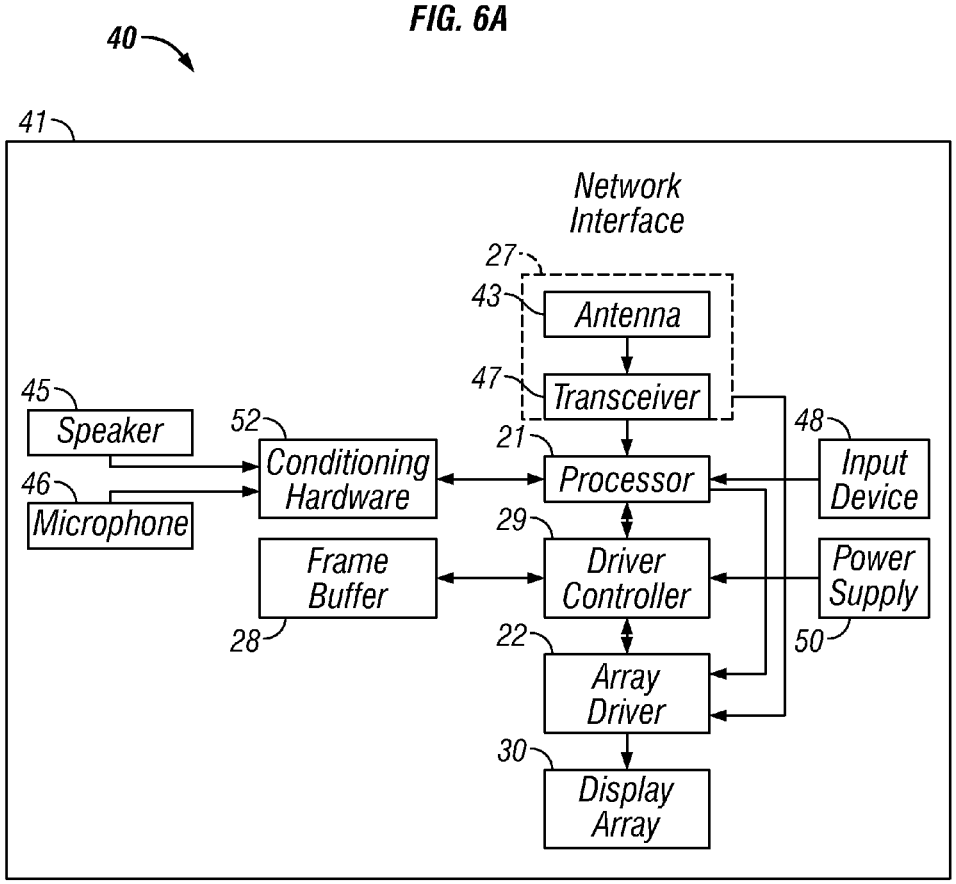

FIGS. 6A and 6B are system block diagrams illustrating an embodiment of a display device 40. The display device 40 can be, for example, a cellular or mobile telephone. However, the same components of display device 40 or slight variations thereof are also illustrative of various types of display devices such as televisions and portable media players.

The display device 40 includes a housing 41, a display 30, an antenna 43, a speaker 45, an input device 48, and a microphone 46. The housing 41 is generally formed from any of a variety of manufacturing processes, including injection molding, and vacuum forming. In addition, the housing 41 may be made from any of a variety of materials, including but not limited to plastic, metal, glass, rubber, and ceramic, or a combination thereof. In one embodiment the housing 41 includes removable portions (not shown) that may be interchanged with other removable portions of different color, or containing different logos, pictures, or symbols.

The display 30 of exemplary display device 40 may be any of a variety of displays, including a bi-stable display, as described herein. In other embodiments, the display 30 includes a flat-panel display, such as plasma, EL, OLED, STN LCD, or TFT LCD as described above, or a non-flat-panel display, such as a CRT or other tube device. However, for purposes of describing the present embodiment, the display 30 includes an interferometric modulator display, as described herein.

The components of one embodiment of exemplary display device 40 are schematically illustrated in FIG. 6B. The illustrated exemplary display device 40 includes a housing 41 and can include additional components at least partially enclosed therein. For example, in one embodiment, the exemplary display device 40 includes a network interface 27 that includes an antenna 43 which is coupled to a transceiver 47. The transceiver 47 is connected to a processor 21, which is connected to conditioning hardware 52. The conditioning hardware 52 may be configured to condition a signal (e.g. filter a signal). The conditioning hardware 52 is connected to a speaker 45 and a microphone 46. The processor 21 is also connected to an input device 48 and a driver controller 29. The driver controller 29 is coupled to a frame buffer 28, and to an array driver 22, which in turn is coupled to a display array 30. A power supply 50 provides power to all components as required by the particular exemplary display device 40 design.

The network interface 27 includes the antenna 43 and the transceiver 47 so that the exemplary display device 40 can communicate with one ore more devices over a network. In one embodiment, the network interface 27 may also have some processing capabilities to relieve requirements of the processor 21. The antenna 43 is any antenna for transmitting and receiving signals. In one embodiment, the antenna transmits and receives RF signals according to the IEEE 802.11 standard, including IEEE 802.11(a), (b), or (g). In another embodiment, the antenna transmits and receives RF signals according to the BLUETOOTH standard. In the case of a cellular telephone, the antenna is designed to receive CDMA, GSM, AMPS, W-CDMA, or other known signals that are used to communicate within a wireless cell phone network. The transceiver 47 pre-processes the signals received from the antenna 43 so that they may be received by and further manipulated by the processor 21. The transceiver 47 also processes signals received from the processor 21 so that they may be transmitted from the exemplary display device 40 via the antenna 43.

In an alternative embodiment, the transceiver 47 can be replaced by a receiver. In yet another alternative embodiment, network interface 27 can be replaced by an image source, which can store or generate image data to be sent to the processor 21. For example, the image source can be a digital video disc (DVD) or a hard-disc drive that contains image data, or a software module that generates image data.

Processor 21 generally controls the overall operation of the exemplary display device 40. The processor 21 receives data, such as compressed image data from the network interface 27 or an image source, and processes the data into raw image data or into a format that is readily processed into raw image data. The processor 21 then sends the processed data to the driver controller 29 or to frame buffer 28 for storage. Raw data typically refers to the information that identifies the image characteristics at each location within an image. For example, such image characteristics can include color, saturation, and gray-scale level.

In one embodiment, the processor 21 includes a microcontroller, CPU, or logic unit to control operation of the exemplary display device 40. Conditioning hardware 52 generally includes amplifiers and filters for transmitting signals to the speaker 45, and for receiving signals from the microphone 46. Conditioning hardware 52 may be discrete components within the exemplary display device 40, or may be incorporated within the processor 21 or other components.

The driver controller 29 takes the raw image data generated by the processor 21 either directly from the processor 21 or from the frame buffer 28 and reformats the raw image data appropriately for high speed transmission to the array driver 22. Specifically, the driver controller 29 reformats the raw image data into a data flow having a raster-like format, such that it has a time order suitable for scanning across the display array 30. Then the driver controller 29 sends the formatted information to the array driver 22. Although a driver controller 29, such as a LCD controller, is often associated with the system processor 21 as a stand-alone Integrated Circuit (IC), such controllers may be implemented in many ways. They may be embedded in the processor 21 as hardware, embedded in the processor 21 as software, or fully integrated in hardware with the array driver 22.

Typically, the array driver 22 receives the formatted information from the driver controller 29 and reformats the video data into a parallel set of waveforms that are applied many times per second to the hundreds and sometimes thousands of leads coming from the display's x-y matrix of pixels.

In one embodiment, the driver controller 29, array driver 22, and display array 30 are appropriate for any of the types of displays described herein. For example, in one embodiment, driver controller 29 is a conventional display controller or a bi-stable display controller (e.g., an interferometric modulator controller). In another embodiment, array driver 22 is a conventional driver or a bi-stable display driver (e.g., an interferometric modulator display). In one embodiment, a driver controller 29 is integrated with the array driver 22. Such an embodiment is common in highly integrated systems such as cellular phones, watches, and other small area displays. In yet another embodiment, display array 30 is a typical display array or a bi-stable display array (e.g., a display including an array of interferometric modulators).

The input device 48 allows a user to control the operation of the exemplary display device 40. In one embodiment, input device 48 includes a keypad, such as a QWERTY keyboard or a telephone keypad, a button, a switch, a touch-sensitive screen, a pressure- or heat-sensitive membrane. In one embodiment, the microphone 46 is an input device for the exemplary display device 40. When the microphone 46 is used to input data to the device, voice commands may be provided by a user for controlling operations of the exemplary display device 40.

Power supply 50 can include a variety of energy storage devices as are well known in the art. For example, in one embodiment, power supply 50 is a rechargeable battery, such as a nickel-cadmium battery or a lithium ion battery. In another embodiment, power supply 50 is a renewable energy source, a capacitor, or a solar cell, including a plastic solar cell, and solar-cell paint. In another embodiment, power supply 50 is configured to receive power from a wall outlet.

In some implementations, control programmability resides, as described above, in a driver controller which can be located in several places in the electronic display system. In some cases, control programmability resides in the array driver 22. The above-described optimization may be implemented in any number of hardware and/or software components and in various configurations.

Figure 7A:
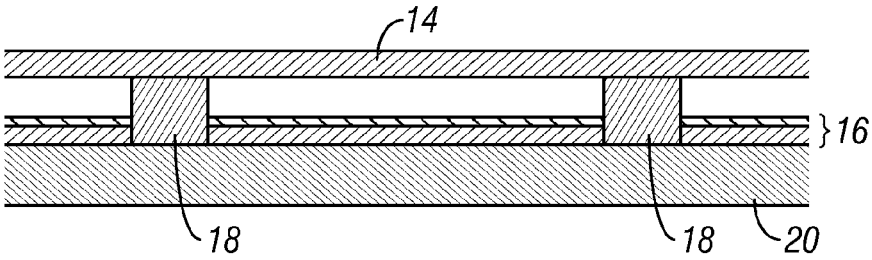
FIG. 7A is a cross section of the device of FIG. 1.
Figure 7B:
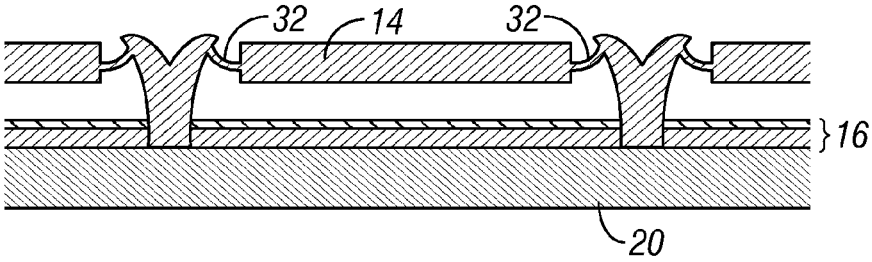
FIG. 7B is a cross section of an alternative embodiment of an interferometric modulator.
Figure 7C:
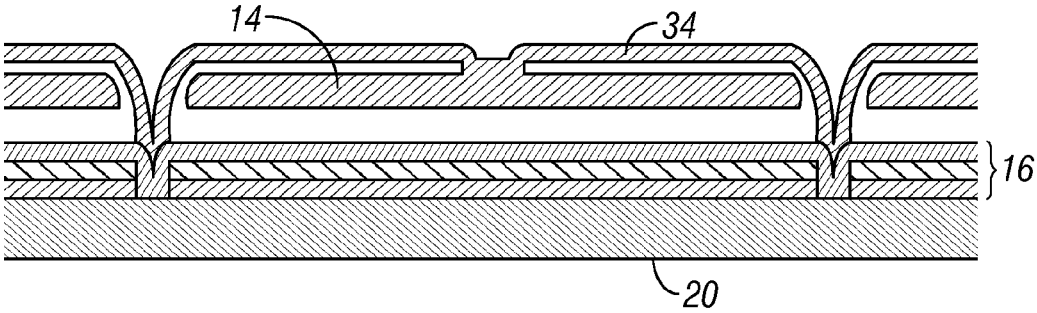
FIG. 7C is a cross section of another alternative embodiment of an interferometric modulator.
Figure 7D:
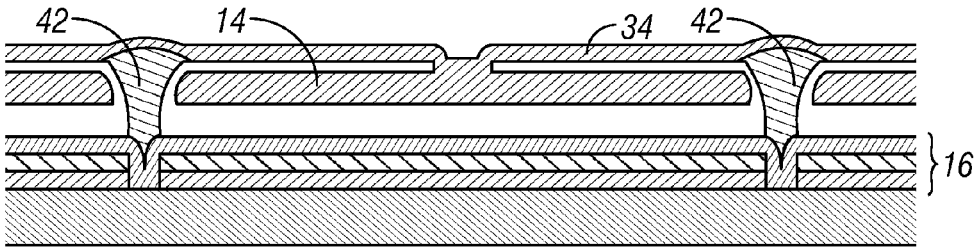
FIG. 7D is a cross section of yet another alternative embodiment of an interferometric modulator.
Figure 7E:
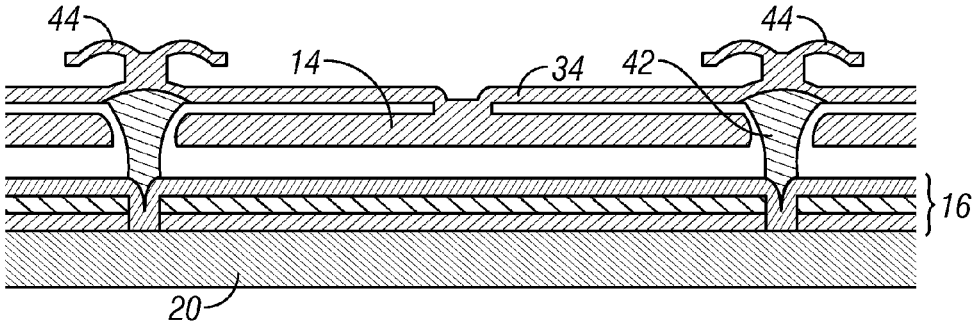
FIG. 7E is a cross section of an additional alternative embodiment of an interferometric modulator.

The details of the structure of interferometric modulators that operate in accordance with the principles set forth above may vary widely. For example, FIGS. 7A-7E illustrate five different embodiments of the movable reflective layer 14 and its supporting structures. FIG. 7A is a cross section of the embodiment of FIG. 1, where a strip of metal material 14 is deposited on orthogonally extending supports 18. In FIG. 7B, the moveable reflective layer 14 of each interferometric modulator is square or rectangular in shape and attached to supports at the corners only, on tethers 32. In FIG. 7C, the moveable reflective layer 14 is square or rectangular in shape and suspended from a deformable layer 34, which may comprise a flexible metal. The deformable layer 34 connects, directly or indirectly, to the substrate 20 around the perimeter of the deformable layer 34. These connections are herein referred to as support posts. The embodiment illustrated in FIG. 7D has support post plugs 42 upon which the deformable layer 34 rests. The movable reflective layer 14 remains suspended over the gap, as in FIGS. 7A-7C, but the deformable layer 34 does not form the support posts by filling holes between the deformable layer 34 and the optical stack 16. Rather, the support posts are formed of a planarization material, which is used to form support post plugs 42. The embodiment illustrated in FIG. 7E is based on the embodiment shown in FIG. 7D, but may also be adapted to work with any of the embodiments illustrated in FIGS. 7A-7C as well as additional embodiments not shown. In the embodiment shown in FIG. 7E, an extra layer of metal or other conductive material has been used to form a bus structure 44. This allows signal routing along the back of the interferometric modulators, eliminating a number of electrodes that may otherwise have had to be formed on the substrate 20.

In embodiments such as those shown in FIG. 7, the interferometric modulators function as direct-view devices, in which images are viewed from the front side of the transparent substrate 20, the side opposite to that upon which the modulator is arranged. In these embodiments, the reflective layer 14 optically shields the portions of the interferometric modulator on the side of the reflective layer opposite the substrate 20, including the deformable layer 34. This allows the shielded areas to be configured and operated upon without negatively affecting the image quality. For example, such shielding allows the bus structure 44 in FIG. 7E, which provides the ability to separate the optical properties of the modulator from the electromechanical properties of the modulator, such as addressing and the movements that result from that addressing. This separable modulator architecture allows the structural design and materials used for the electromechanical aspects and the optical aspects of the modulator to be selected and to function independently of each other. Moreover, the embodiments shown in FIGS. 7C-7E have additional benefits deriving from the decoupling of the optical properties of the reflective layer 14 from its mechanical properties, which are carried out by the deformable layer 34. This allows the structural design and materials used for the reflective layer 14 to be optimized with respect to the optical properties, and the structural design and materials used for the deformable layer 34 to be optimized with respect to desired mechanical properties.

In other embodiments, alternate drive schemes may be utilized to minimize the power required to drive the display, as well as to allow a common line of electromechanical devices to be written to in a shorter amount of time. In certain embodiments, a release or relaxation time of an electromechanical device such as an interferometric modulator may be longer than an actuation time of the electromechanical device, as the electromechanical device may be pulled to an unactuated or released state only via the mechanical restoring force of the movable layer. In contrast, the electrostatic force actuating the electromechanical device may act more quickly on the electromechanical device to cause actuation of the electromechanical device. In the high voltage drive scheme discussed above, the write time for a given line must be sufficient to allow not only the actuation of previously unactuated electromechanical devices, but to allow for the unactuation of previously actuated electromechanical devices. The release rate of the electromechanical devices thus acts as a limiting factor in certain embodiments, which may inhibit the use of higher refresh rates for larger display arrays.

Figure 8:
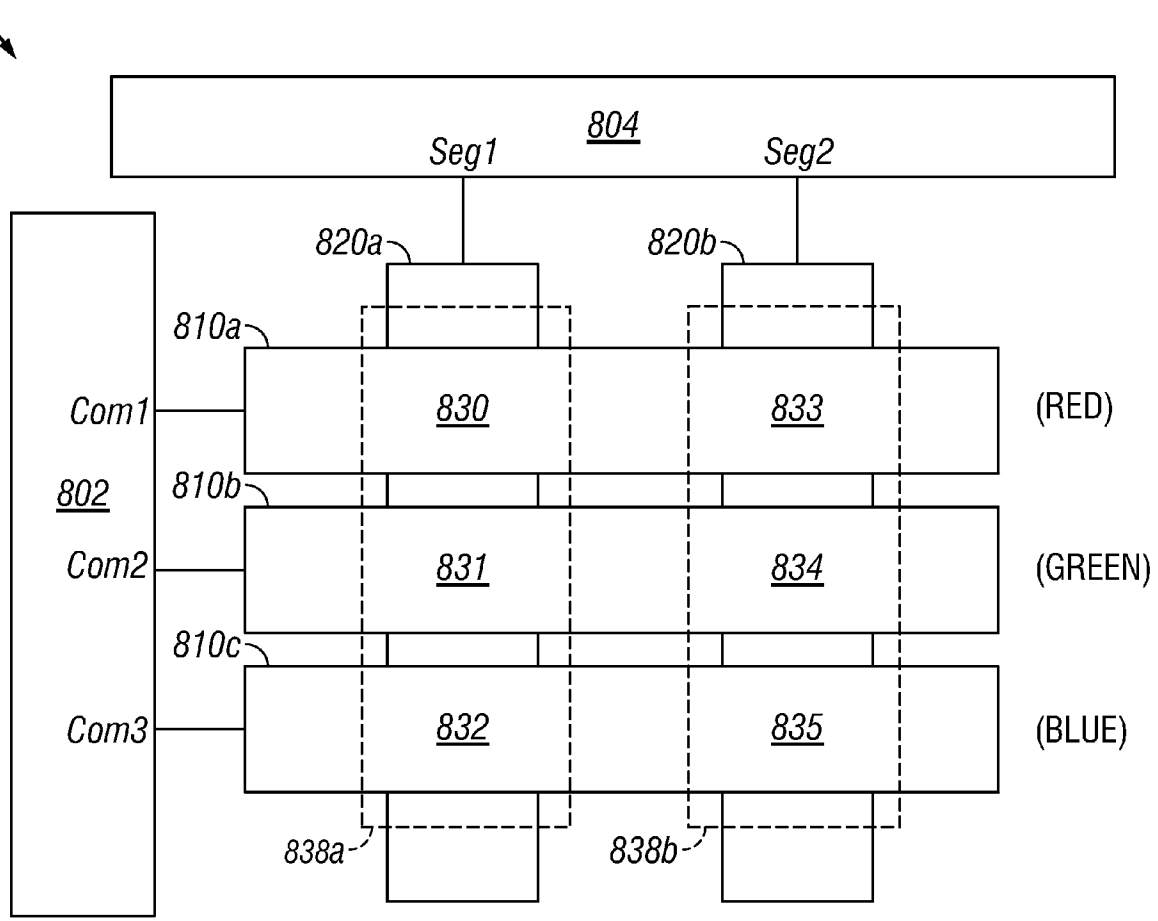
FIG. 8 is a schematic illustration of a 2×3 array of interferometric modulators illustrating color pixels.

An alternate drive scheme, referred to herein as a low voltage drive scheme, may provide improved performance over the drive scheme discussed above, in which the bias voltage is supplied by the common electrode rather than the segment electrode. This is illustrated by reference to FIGS. 8 and 9. FIG. 8 illustrates an exemplary 2×3 array segment 800 of interferometric modulators, wherein the array includes three common lines 810*a*, 810*b*, and 810*c*, and two segment lines 820*a*, 820*b*. An independently addressable pixel 830, 831, 832, 833, 834, and 835 is located at each intersection of a common line and a segment line. Thus, the voltage across pixel 830 is the difference between the voltages applied on common line 810*a* and segment line 820*a*. This voltage differential across a pixel is alternately referred to herein as a pixel voltage. Similarly, pixel 831 is the intersection of common line 810*b* and segment line 820*a*, and pixel 832 is the intersection of column line 810*c* and segment line 820*a*. Pixels 833, 834, and 835 are the intersections of segment line 820*b* with common lines 810*a*, 810*b*, and 810*c*, respectively. In the illustrated embodiment, the common lines comprise a movable electrode, and the electrode in the segment lines are fixed portions of an optical stack, but it will be understood that in other embodiments the segment lines may comprise movable electrodes, and the common lines may comprise fixed electrodes. Common voltages may be applied to common lines 810*a*, 810*b*, and 810*c* by common driver circuitry 802, and segment voltages may be applied to segment lines 820*a* and 820*b* via segment driver circuitry 804.

As will be explained further below, the pixels along each column line may be formed to reflect a different color. To make a color display, for example, the display may contain rows (or columns) of red, green, and blue pixels. Thus, the Com1 output of driver 802 may drive a line of red pixels, the Com2 output of driver 802 may drive a line of green pixels, and the Com3 output of driver 802 may drive a line of blue pixels. It will be appreciated that in an actual display, there may be hundreds of red, green, blue sets of pixel lines extending down, with FIG. 8 showing only the first set.

In one embodiment of an alternate drive scheme, the voltage applied on segment lines 820*a* and 820*b* is switched between a positive segment voltage $V_{SP}$ and a negative segment voltage $V_{SN}$. The voltage applied on common lines 810*a*, 810*b*, and 810*c* is switched between 5 different voltages, one of which is a ground state in certain embodiments. The four non-ground voltages are a positive hold voltage $V_{CP}$, a positive overdrive voltage $V_{OVP}$, a negative hold voltage $V_{CN}$, and a negative overdrive voltage $V_{OVN}$. The hold voltages are selected such that the pixel voltage will always lie within the hysteresis windows of the pixels (the positive hysteresis value for the positive hold voltage and the negative hysteresis value for the negative hold voltage) when appropriate segment voltages are used, and the absolute values of the possible segment voltages are sufficiently low that a pixel with a hold voltage applied on its common line will thus remain in the current state regardless of the particular segment voltage currently applied on its segment line.

In a particular embodiment, the positive segment voltage $V_{SP}$ may be a relatively low voltage, on the order of 1 V-2V, and the negative segment voltage $V_{SN}$ may be ground or may be a negative voltage of 1V-2V. Because the positive and negative segment voltages may not be symmetric about the ground, the absolute value of the positive hold and overdrive voltages may be less than the absolute value of the negative hold and overdrive voltages. As it is the pixel voltage which controls actuation, not just the particular line voltages, this offset will not affect the operation of the pixel in a detrimental manner, but needs merely to be accounted for in determining the proper hold and overdrive voltages.

Figure 9:
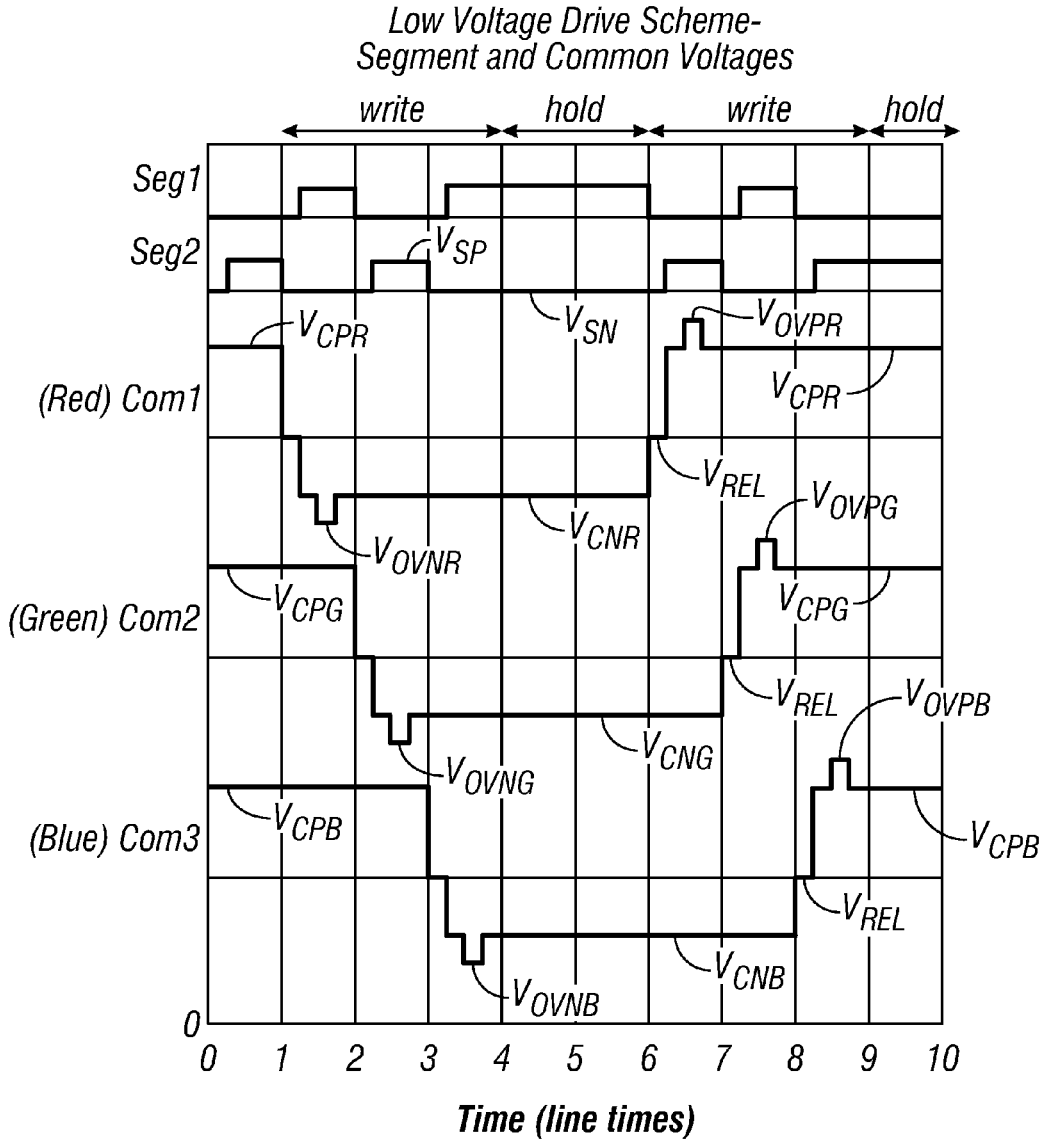
FIG. 9 illustrates an exemplary timing diagram for segment and common signals that may be used to write frames of display data to the 2×3 display of FIG. 8 using another example drive scheme.

FIG. 9 illustrates exemplary voltage waveforms which may be applied on the segment lines and common lines of FIG. 8. Waveform Seg1 represents the segment voltage as a function of time applied along segment line 820*a* of FIG. 8, and waveform Seg2 represents the segment voltage applied along segment line 820*b*. Waveform Com1 represents the common voltage applied along column line 810*a* of FIG. 8, waveform Com2 represents the common voltage applied along column line 810*b*, and waveform Com3 represents the common voltage applied along column line 810*c*.

In FIG. 9, it can be seen that each of the common line voltages begins at a positive hold value ($V_{CPR}$, $V_{CPG}$ and $V_{CPB}$ respectively). These hold values are designated differently because they will generally be different voltage levels depending on whether a red (R) line of pixels, a green (G) line of pixels, or a blue (B) line of pixels is being driven. As noted above, the state of the pixels along all common lines remain constant during application of the positive hold voltage along the common lines, regardless of the state of the segment voltages.

The common line voltage on common line 810*a* (Com1) then moves to a state $V_{REL}$, which may be ground, causing release of the pixels 830 and 833 along common line 810*a*. It can be noted in this particular embodiment that the segment voltages are both negative segment voltages $V_{SN}$ at this point (as can be seen in waveforms Seg1 and Seg2), which may be ground, but given proper selection of voltage values, the pixels would release even if either of the segment voltages was at the positive segment voltage $V_{SP}$.

The common line voltage on line 810*a* (Com1) then moves to a negative hold value $V_{CNR}$. When the voltage is at the negative hold value, the segment line voltage for segment line 820*a* (waveform Seg1) is at a positive segment voltage $V_{SP}$, and the segment line voltage for segment line 820*b* (waveform Seg2) is at a negative segment voltage $V_{SN}$. The voltage across each of pixels 830 and 833 moves past the release voltage $V_{REL}$ to within the positive hysteresis window without moving beyond the positive actuation voltage. Pixels 830 and 833 thus remain in their previously released state.

The common line voltage on line 810*a* (waveform Com1) is then decreased to a negative overdrive voltage $V_{OVNR}$. The behavior of the pixels 830 and 833 is now dependent upon the segment voltages currently applied along their respective segment lines. For pixel 830, the segment line voltage for segment line 820*a* is at a positive segment voltage $V_{SP}$, and the pixel voltage of pixel 830 increases beyond the positive actuation voltage. Pixel 830 is thus actuated at this time. For pixel 833, the segment line voltage for segment line 820*b* is at a negative segment voltage $V_{SN}$, the pixel voltage does not increase beyond the positive actuation voltage, so pixel 833 remains unactuated.

Next, the common line voltage along line 810*a* (waveform Com1) is increased back to the negative hold voltage $V_{CNR}$. As previously discussed, the voltage differential across the pixels remains within the hysteresis window when the negative hold voltage is applied, regardless of the segment voltage. The voltage across pixel 830 thus drops below the positive actuation voltage but remains above the positive release voltage, and thus remains actuated. The voltage across pixel 833 does not drop below the positive release voltage, and will remain unactuated.

As indicated in FIG. 9, the common line voltage on common lines 810*b* and 810*c* moves in a similar fashion, with a delay of one line time cycle between each of the common lines to write the frame of display data to the array. After a hold period, the process is repeated with the common and segment voltages of opposite polarities.

As mentioned above; in a color display, the exemplary array segment 800 illustrated in FIG. 8 may comprise three colors of pixels, with each of the pixels 830-835 comprising a pixel of a particular color. The colored pixels may be arranged such that each common line 810*a*, 810*b*, 810*c* defines a common line of pixels of similar colors. For example, in an RGB display, pixels 830 and 833 along common line 810*a* may comprise red pixels, pixels 831 and 834 along common line 810*b* may comprise green pixels, and pixels 832 and 835 along common line 810*c* may comprise blue pixels. Thus, the 2×3 array may in an RGB display form two composite multicolor pixels 838*a* and 838*b*, where the multicolor pixel 838*a* comprises red subpixel 830, green subpixel 831, and blue subpixel 832, and the multicolor pixel 838*b* comprises red subpixel 833, green subpixel 834, and blue subpixel 835.

In such an array with different color pixels, the structure of the different color pixels varies with color. These structural differences result in differences in hysteresis characteristics, which further result in different suitable hold and actuation voltages. Assuming that the release voltage $V_{REL}$ is zero (ground), to drive an array of three different color pixels with the waveforms of FIG. 9, a power supply would need to generate a total of fourteen different voltages ($V_{OVPR}$, $V_{CPR}$, $V_{CNR}$, $V_{OVNR}$, $V_{OVPG}$, $V_{CPG}$, $V_{CNG}$, $V_{OVNG}$, $V_{OVPB}$, $V_{CPB}$, $V_{CNB}$, $V_{OVNB}$, $V_{SP}$ and $V_{SN}$) to drive the common and segment lines.

Figure 10:
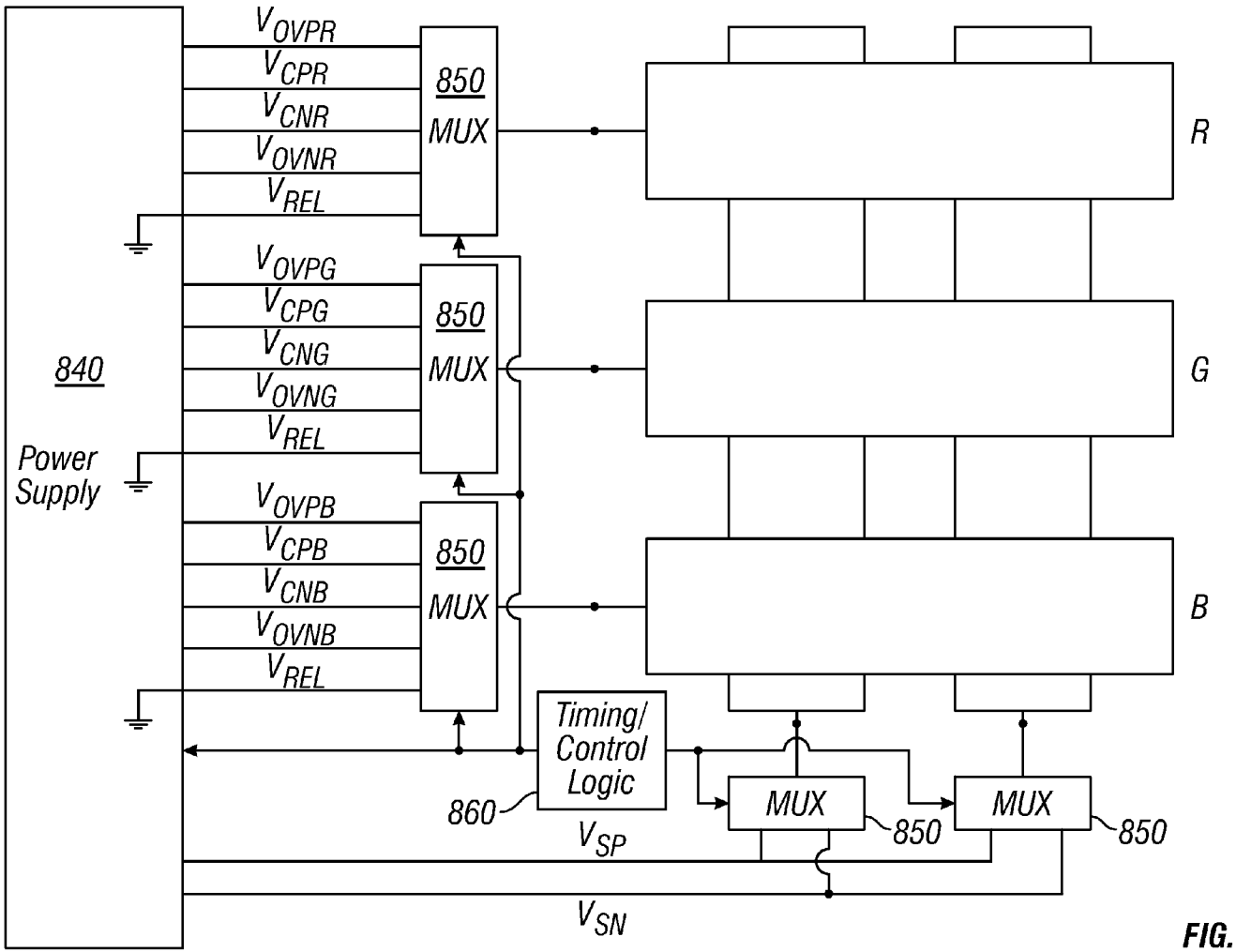
FIG. 10 is a system block diagram illustrating the generation and application of various voltages to a display when using the drive scheme of FIG. 9.

FIG. 10 illustrates an embodiment of driver circuitry using such a power supply 840. The various voltages generated would be appropriately combined to produce the illustrated waveforms using, for example, multiplexers 850, and timing/controller logic 860 that are part of the drive circuits 802, 804 of FIG. 8. Continuously generating these fourteen voltage levels consumes a significant amount of power, especially since the overdrive voltages are only needed for short periods of time. This power consumption can be reduced because the positive and negative overdrive voltages $V_{OVP}$ and $V_{OVN}$ for each different color may be obtained by adding an additional voltage $V_{ADD}$ to the positive hold voltage $V_{CP}$, and subtracting $V_{ADD}$ from the negative hold voltage $V_{CN}$, where $V_{ADD}$ is the same for all colors and may itself be equal to the difference between $V_{SP}$ and $V_{SN}$. To take advantage of this, the power supply 840 uses a charge pump to derive the overdrive voltages from the hold voltages at the times required.

Figure 11:
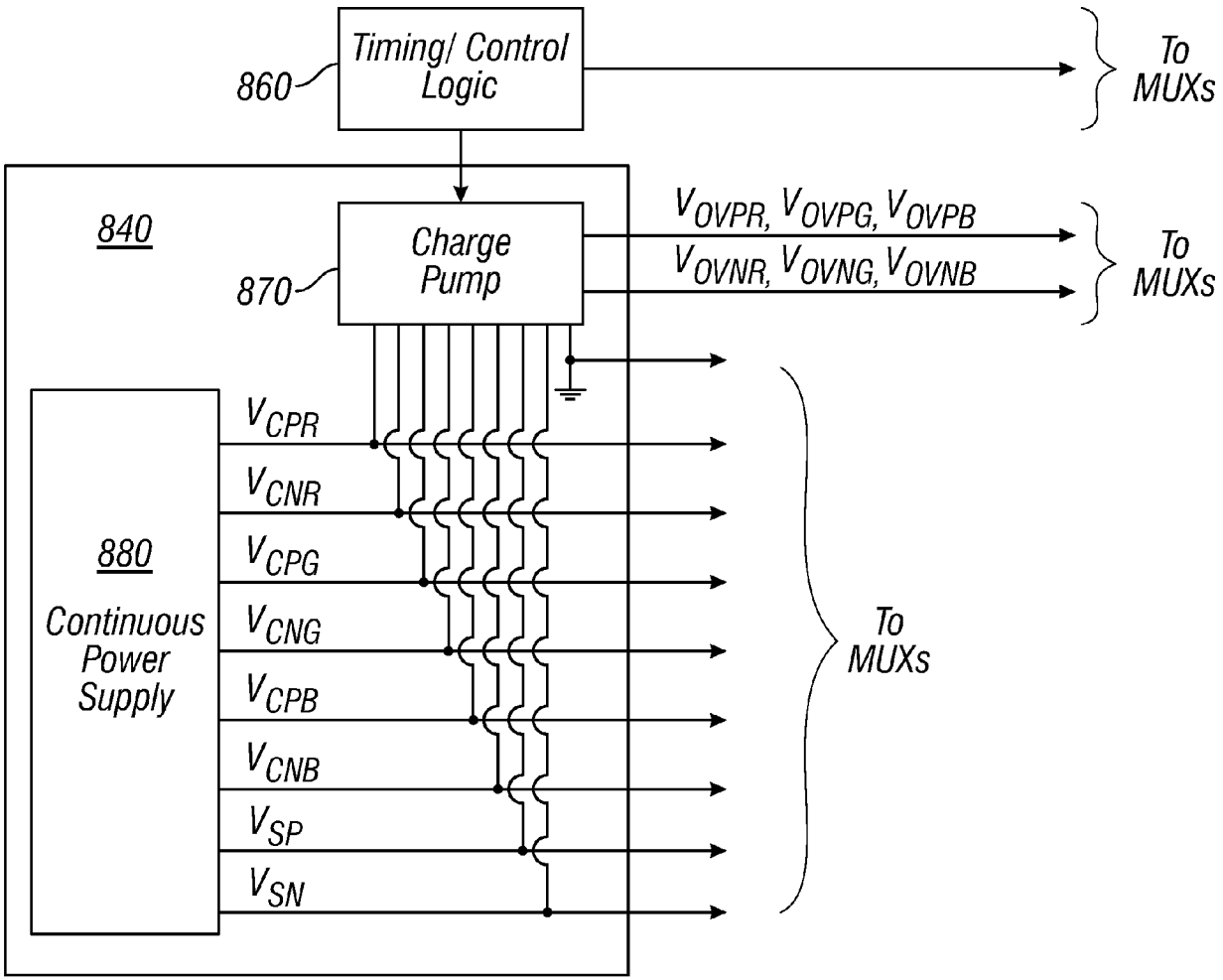
FIG. 11 is a system block diagram illustrating an embodiment of the power supply of FIG. 10.

FIG. 11 is a system block diagram illustrating the generation of the various voltages used in a low voltage drive scheme according to an embodiment of the charge pump containing power supply described herein. As can be seen in FIG. 11, by using an embodiment of the charge pump circuit 870 (an embodiment of which is described in FIG. 12 below), a continuous power supply 880 need only generate a total of eight different voltages ($V_{CPR}$, $V_{CNR}$, $V_{CPG}$, $V_{CNG}$, $V_{CPB}$, $V_{CNB}$, $V_{SP}$ and $V_{SN}$) for the common lines and segment lines. It may be noted here that the "continuous" power supply need not be in operation 100% of the time. The term continuous is intended only to mean that this power supply outputs these voltages when needed to drive and hold the display elements. In typical embodiments, the hold voltages are required a large proportion of the time that the display is in operation, and therefore at least the hold voltages will be output during those periods when the display is being used to output an image. In some embodiments, however, it is possible to hold images on the display for some time periods without these outputs. The charge pump 870 then generates the remaining six voltages ($V_{OVPR}$, $V_{OVNR}$, $V_{OVPG}$, $V_{OVNG}$, $V_{OVPB}$, $V_{OVNB}$) required to drive the array by adding (or subtracting) the difference between $V_{SP}$ and $V_{SN}$ to each hold voltage, as will be explained in further detail below. In addition, by using a timing and logic controller, it is possible to synchronize the output of the charge pump circuit with the common line waveforms produced by the timing circuit in order to drive the array of FIG. 8.

Figure 12:
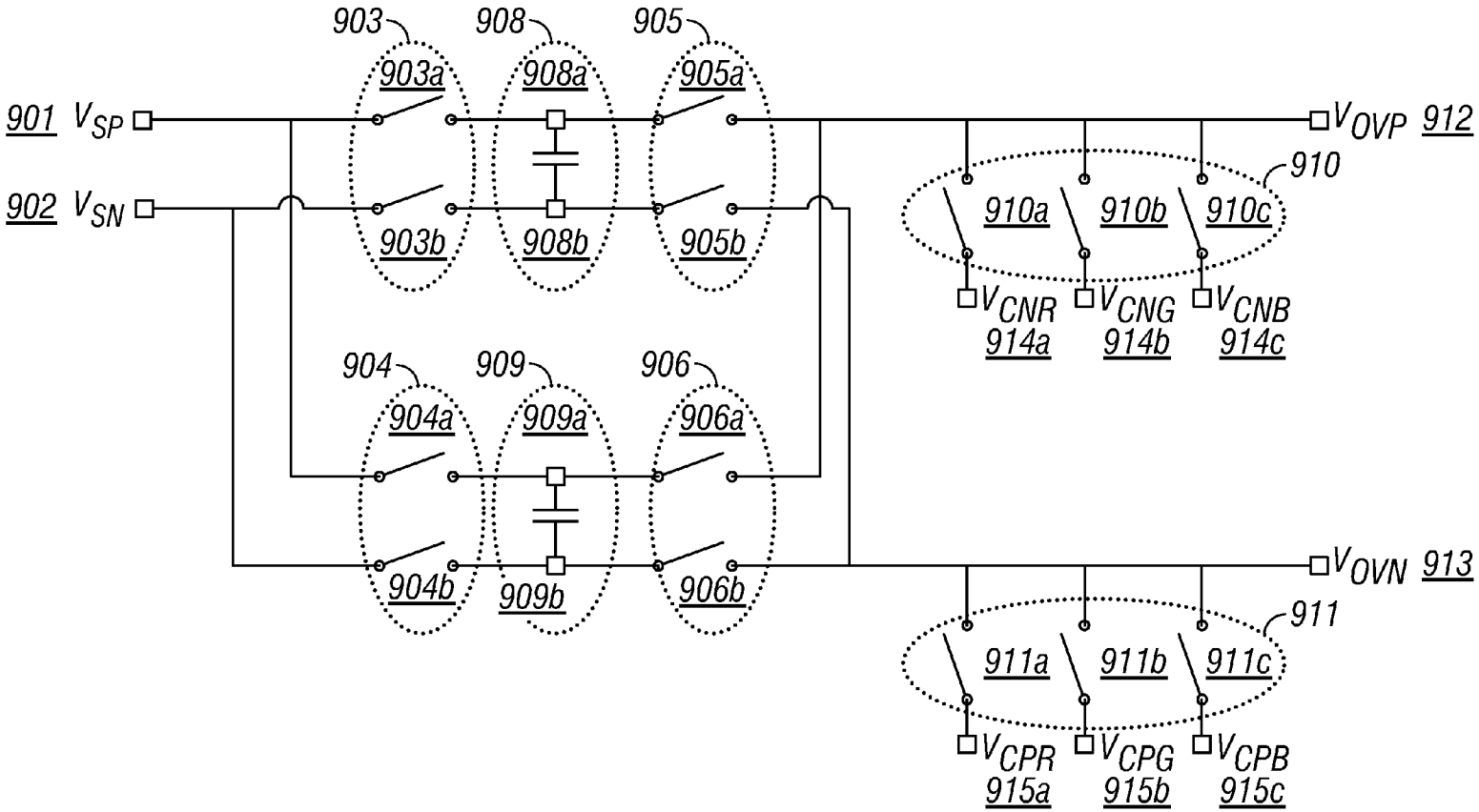
FIG. 12 illustrates a circuit diagram of an embodiment of a charge pump to generate overdrive voltages useable in the system of FIG. 11.

FIG. 12 illustrates a circuit diagram of an embodiment of charge pump circuitry to generate the overdrive voltages, $V_{OV}$. The circuitry illustrated comprises a supply voltage $V_{SP}$ across terminals $V_{SP}$ 901 and $V_{SN}$ 902 (where as noted above $V_{SN}$ may be ground in some embodiments), pairs of switches 903, 904, 905 and 906, plurality of switches 910, 911, alternating capacitors 908 and 909, and lines 914*a*-914*c* and 915*a*-915*c* as inputs for negative and positive hold voltages $V_C$, for red, green and blue pixels.

Still referring to FIG. 12, Switch 903*a* couples the positive terminal of the supply voltage, $V_{SP}$ 901, to the positive terminal of the first alternating capacitor, 908*a*. Similarly, switch 903*b* couples the negative terminal of the supply voltage, $V_{SN}$ 902, to the negative terminal of the first alternating capacitor, 908*b*. Switch 904*a* couples the positive terminal of the supply voltage, $V_{SP}$ 901, to the positive terminal of the second alternating capacitor, 909*a*. Similarly, switch 904*b* couples the negative terminal of the supply voltage, $V_{SN}$ 902, to the negative terminal of the second alternating capacitor, 909*b*. Switch 905*a* couples the positive terminal of the first alternating capacitor, 908*a* to the positive overdrive voltage line $V_{OVP}$, 912. Similarly, switch 905*b* couples the negative terminal of the first alternating capacitor, 908*b* to the negative overdrive voltage line $V_{OVN}$, 913. Switch 906*a* couples the positive terminal of the second alternating capacitor, 909*a* to the positive overdrive voltage line $V_{OVP}$, 912. Similarly, switch 906*b* couples the negative terminal of the second alternating capacitor, 909*b* to the negative overdrive voltage line $V_{OVN}$, 913. Switch 910*a* couples the positive overdrive voltage line. $V_{OVP}$, 912 to the negative hold voltage for driving a red pixel, $V_{CNR}$, 914*a*. Similarly, switch 910*b* couples the positive overdrive voltage line $V_{OVP}$, 912 to the negative hold voltage for driving a green pixel, $V_{CNG}$, 914*b*. Furthermore, switch 910*c* couples the positive overdrive voltage line $V_{OVP}$, 912 to the negative hold voltage for driving a blue pixel, $V_{CNB}$, 914*c*. Similarly, switch 911*a* couples the negative overdrive voltage line $V_{OVN}$, 913 to the positive hold voltage for driving a red pixel, $V_{CPR}$, 915*a*. Similarly, switch 911*b* couples the negative overdrive voltage line $V_{OVN}$, 913 to the positive hold voltage for driving a green pixel, $V_{CPG}$, 915*b*. Furthermore, switch 911*c* couples the negative overdrive voltage line $V_{OVN}$, 913 to the positive hold voltage for driving a blue pixel, $V_{CPB}$, 915*c*.

The timing/control logic circuitry illustrated in FIGS. 10 and 11 ensures that the charge pump operates in such a way that at any point in time, one of the alternating capacitors is being charged with the supply voltage, $V_{SP}$, while the other alternating capacitor is being used to contribute in creating the overdrive voltage, $V_{OV}$. In one cycle, the timing/control logic circuitry closes or activates switches 903 and 906 while opening or deactivating switches 904 and 905 such that capacitor 908 is being charged with the supply voltage, $V_{SP}$, while capacitor 909 is coupled to an output such that the voltage across the capacitor 909 creates an overdrive voltage $V_{OV}$. In another cycle, the timing/control logic circuitry closes or activates switches 904 and 905 while opening or deactivating switches 903 and 906 such that capacitor 909 is being charged with the supply voltage, $V_{SP}$, while the voltage across capacitor 908 is coupled to an output such that the voltage across the capacitor 908 creates an overdrive voltage $V_{OV}$. The voltage across the charged capacitor is thus selectively added to or subtracted from a hold voltage to produce the corresponding overdrive voltage.

During each of the cycles, the timing/control logic circuitry also ensures that only one of the six switches 910*a*-910*c* and 911*a*-911*c* is closed or activated at any one time. The overdrive voltage line, $V_{OV}$ is thus coupled to only one of the common lines at a time. For example, when the timing/control logic circuitry closes switch 910*a*, the overdrive voltage $V_{OV}$ is coupled to the common voltage line for creating a negative hold voltage across a red pixel, $V_{CNR}$ 914*a*. The remaining switches 910*b*-910*c* and 911*a*-911*c* operate in a similar fashion.

In some embodiments, the number of, and connections between different switches and capacitors used may be different, such that the timing/control logic circuitry's activation and deactivation of switches may go through more or less cycles than the circuit described above in order to charge the capacitors and generate the overdrive voltages.

Figure 13:
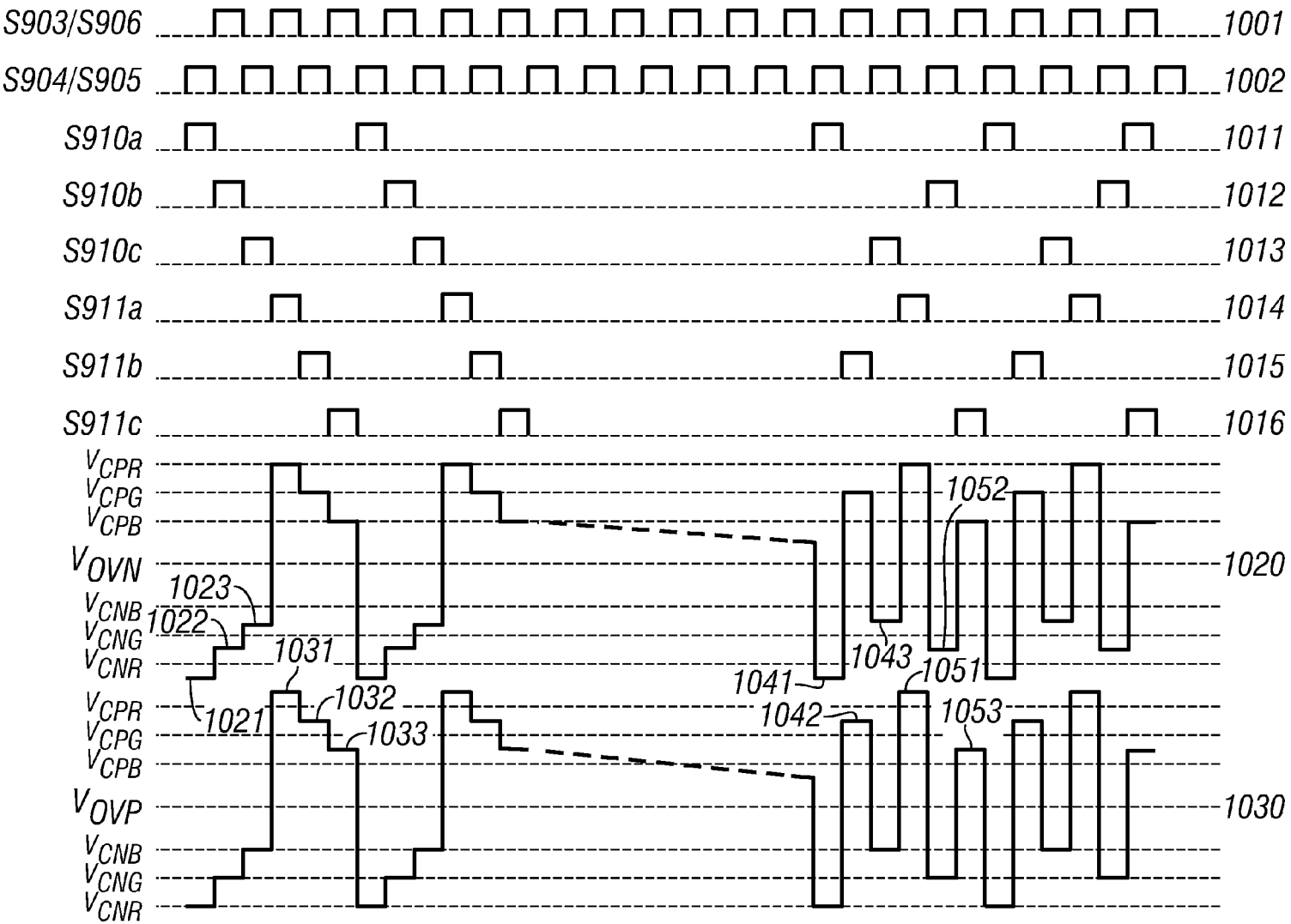
FIG. 13 illustrates a timing diagram for overdrive voltage signals generated by the embodiment of the charge pump illustrated in FIG. 12.

FIG. 13 illustrates a timing diagram for the switches in an embodiment of the charge pump illustrated in FIG. 12 as well as the overdrive voltage signals generated by this embodiment of the charge pump. Waveform 1001 represents the timing of switch activation and deactivation for switches 903 and 906. Waveform 1002 represents the timing of switch activation and deactivation for switches 904 and 905. Waveform 1011 represents the timing of switch activation for switch 910*a*. Waveform 1012 represents the timing of switch activation for switch 910*b*. Waveform 1013 represents the timing of switch activation for switch 910*c*. Waveform 1014 represents the timing of switch activation for switch 911*a*. Waveform 1015 represents the timing of switch activation for switch 911*b*. Waveform 1016 represents the timing of switch activation for switch 911*c*.

Waveforms 1020 and 1030 illustrate the output voltages on lines $V_{OVN}$ and $V_{OVP}$ respectively that are generated by the embodiment of the circuit in FIG. 12 when activating and deactivating the switches as indicated in waveforms 1001-1002 and 1011-1016.

As indicated on the left side of FIG. 13, during the first illustrated cycle, when the switches 904 and 905 are activated, as seen in waveform 1002, and when the switch 910*a* is activated, as seen in waveform 1011, there is a negative overdrive voltage created for a red pixel, as seen at 1021. During the next cycle, switches 903 and 906 are activated, as seen in waveform 1001, and switches 904 and 905 are deactivated as seen in waveform 1002. When the switch 910*b* is activated as seen in waveform 1012, there is a negative overdrive voltage created for a green pixel, as seen at 1022. During the next cycle, switches 904 and 905 are activated again, as seen in waveform 1001, and switches 903 and 906 are deactivated as seen in waveform 1002. When the switch 910*c* is activated as seen in waveform 1013, there is a negative overdrive voltage created for a blue pixel, as seen at 1023. During the next cycle, when the switches 904 and 905 are activated again, as seen in waveform 1002, and when the switch 911*a* is activated, as seen in waveform 1014, there is a positive overdrive voltage created for a red pixel, as seen at 1031. During the next cycle, switches 903 and 906 are activated again, as seen in waveform 1001, and switches 904 and 905 are deactivated as seen in waveform 1002. When the switch 911*b* is activated as seen in waveform 1012, there is a positive overdrive voltage created for a green pixel, as seen at 1032. During the next cycle, switches 904 and 905 are activated again, as seen in waveform 1001, and switches 903 and 906 are deactivated as seen in waveform 1002. When the switch 911*c* is activated as seen in waveform 1013, there is a positive overdrive voltage created for a blue pixel, as seen at 1033. This sequential cycle of switches for the same polarity followed by switches of different polarity may be repeated.

Alternatively, as indicated on the right side of FIG. 13, it is also possible to generate overdrive voltages in other orders. When the switches 904 and 905 are activated, as seen in waveform 1002, and when the switch 910*a* is activated, as seen in waveform 1011, there is a negative overdrive voltage created for a red pixel, as seen at 1041. During the next cycle, switches 903 and 906 are activated again, as seen in waveform 1001, and switches 904 and 905 are deactivated as seen in waveform 1002. When the switch 911*b* is activated as seen in waveform 1012, there is a positive overdrive voltage created for a green pixel, as seen at 1042. During the next cycle, switches 904 and 905 are activated again, as seen in waveform 1001, and switches 903 and 906 are deactivated as seen in waveform 1002. When the switch 910*c* is activated as seen in waveform 1013, there is a negative overdrive voltage created for a blue pixel, as seen at 1043. During the next cycle, when the switches 904 and 905 are activated again, as seen in waveform 1002, and when the switch 911*a* is activated, as seen in waveform 1014, there is a positive overdrive voltage created for a red pixel, as seen at 1051. During the next cycle, switches 903 and 906 are activated again, as seen in waveform 1001, and switches 904 and 905 are deactivated as seen in waveform 1002. When the switch 910*b* is activated as seen in waveform 1012, there is a negative overdrive voltage created for a green pixel, as seen at 1052. During the next cycle, switches 904 and 905 are activated again, as seen in waveform 1001, and switches 903 and 906 are deactivated as seen in waveform 1002. When the switch 911*c* is activated as seen in waveform 1013, there is a positive overdrive voltage created for a blue pixel, as seen at 1053.

Since the timing/logic controller controls switches 910*a*-*c* and 911*a*-911*c* independently of one another, it is possible to generate overdrive voltages for the colors and polarities desired in any order, and not limited to the examples described above. Furthermore, since the timing/logic controller also controls the application of the voltages to the common lines through the multiplexers, the timing/logic controller can be configured to generate the required overdrive voltages at the timing necessary to generate the waveforms of FIG. 9 as they are applied to the different common lines of the display array.

Figure 14:
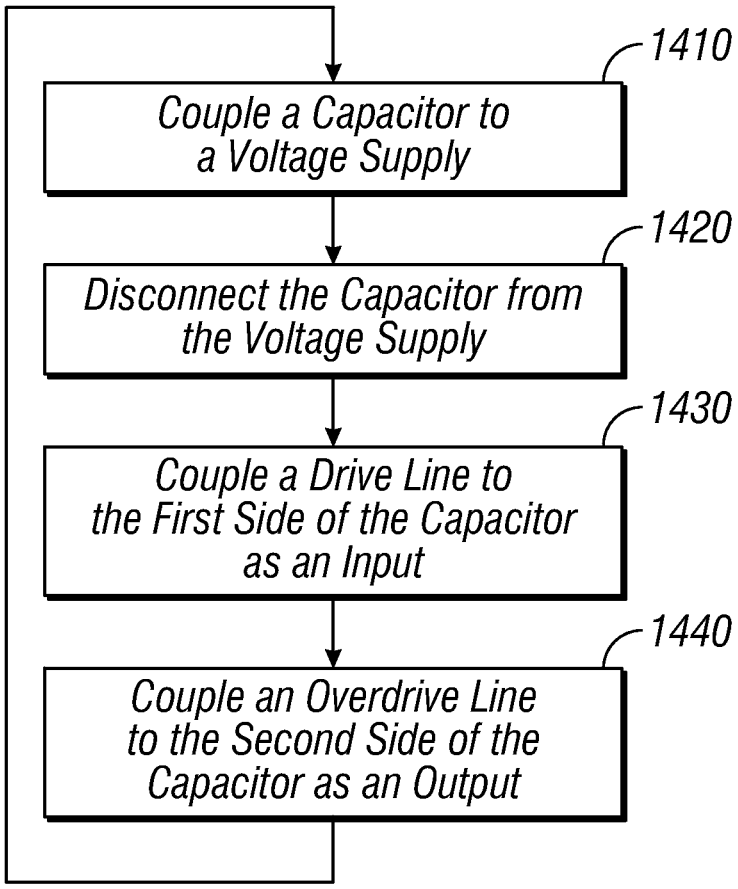
FIG. 14 is a flowchart of an embodiment of a process for generating overdrive voltages.

FIG. 14 is a flowchart of an embodiment of a process for generating overdrive voltages. At step 1410, a capacitor is coupled to a voltage supply. In one embodiment, this coupling is done by activating switches. As a result of the coupling, the capacitor is charged with the voltage from the supply line. At step 1420, the capacitor is disconnected from the voltage supply. In one embodiment, this disconnection is done by deactivating switches. At step 1430, a drive line is connected to the first side of the capacitor as an input. In one embodiment, the drive line may be the common line hold voltage of a display array. At step 1440, an overdrive line is connected to the second side of the capacitor as an output. In one embodiment, the overdrive line may be the common line overdrive voltage of a display array. As indicated in FIG. 14, steps 1410 through 1440 are repeated.

Advantageously, the present method generates the overdrive voltages used to drive the common lines of a display with lower power consumption due to less switching and smaller voltage ranges. The method also provides maximum flexibility to be used in combination with any driving scheme employed by the display driver.

Figure 15:
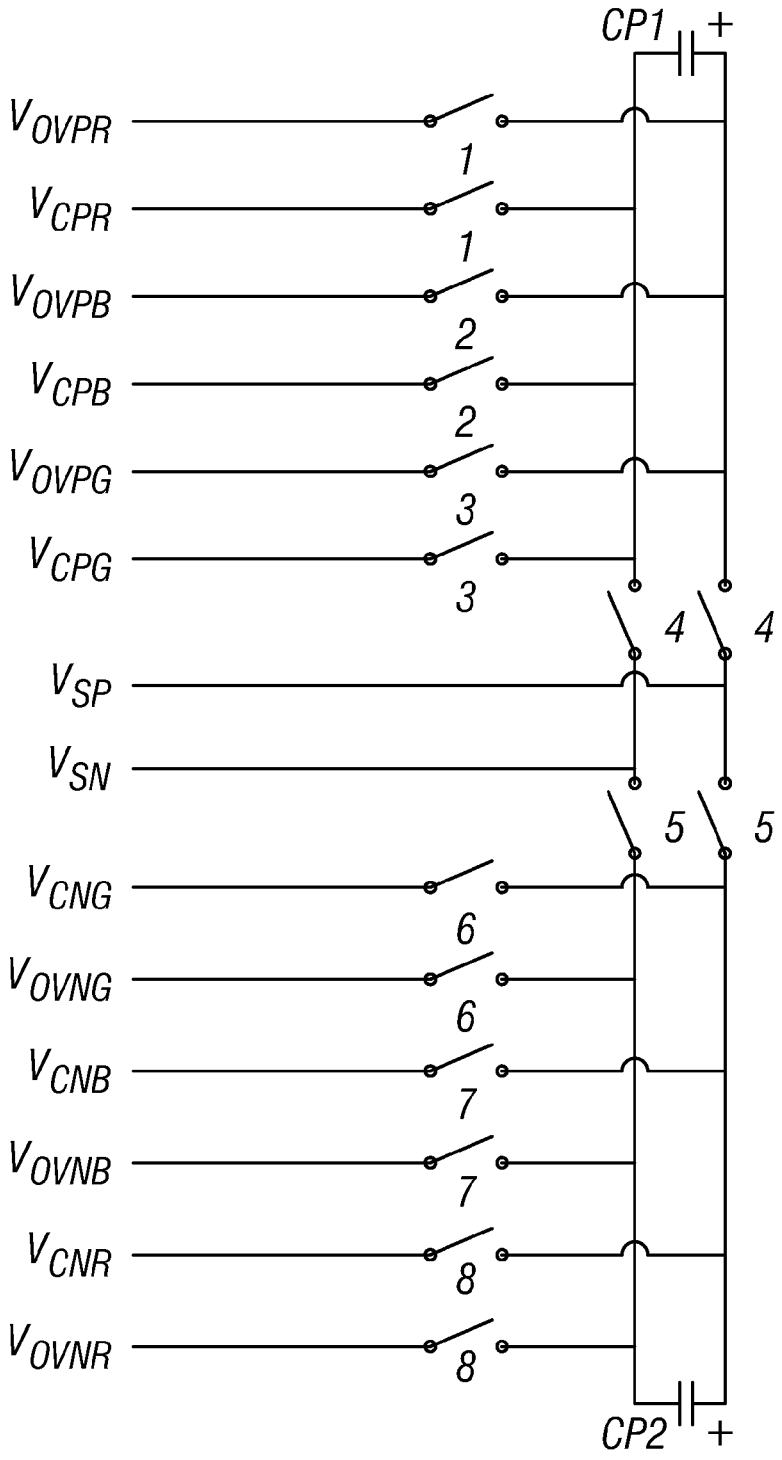
FIG. 15 illustrates a second embodiment of a charge pump for generating overdrive voltages.

FIG. 15 illustrates another embodiment of the charge pump illustrated in FIG. 11. Similar to the embodiment illustrated in FIG. 12, the charge pump illustrated in FIG. 15 also comprises a supply voltage of the difference between $V_{SP}$ and $V_{SN}$, several pairs of switches, and two alternating capacitors. The circuit operates in such a way that during one cycle, one of the alternating capacitors is being charged with the supply voltage while an overdrive voltage is produced with the other capacitor. During another cycle, the other alternating capacitor is being charged with the supply voltage while an overdrive voltage of opposite polarity is being produced with the first capacitor. For example, when switch 5 is closed to charge capacitor CP2, switch 1 may be closed to produce $V_{OVPR}$ from $V_{CPR}$ and capacitor CP1.

Figure 16:
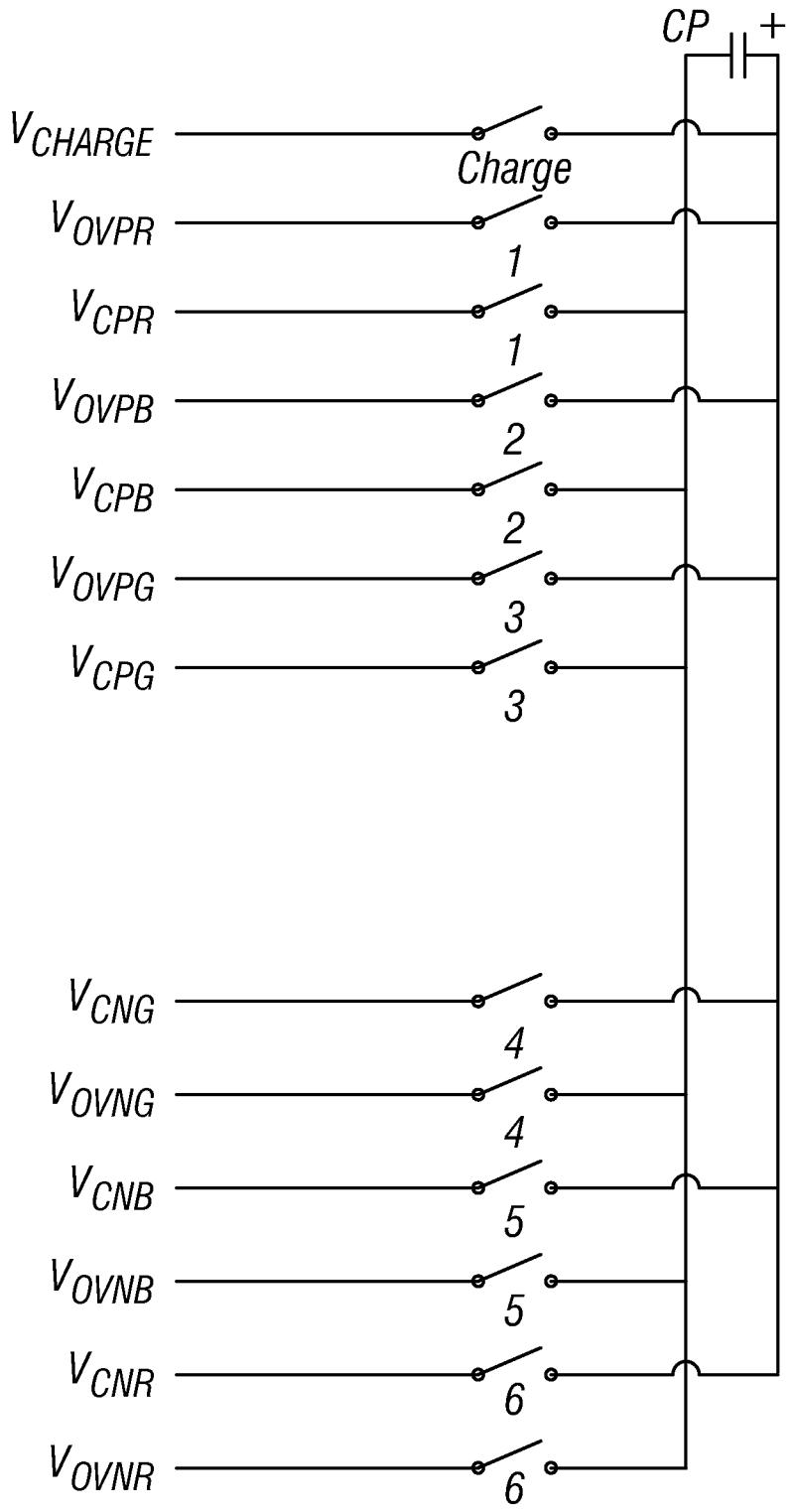
FIG. 16 illustrates a third embodiment of a charge pump for generating overdrive voltages.

FIG. 16 illustrates another embodiment of the charge pump illustrated in FIG. 11. The embodiment in FIG. 16 uses only one capacitor. The circuit operates in such a way that during one cycle, the capacitor is being charged with an additional voltage, $V_{CHARGE}$ from the continuous power supply illustrated in FIG. 11. During this charge cycle, switch Charge and switch 1 are closed. In this embodiment, $V_{CHARGE}$ is produced by the continuous power supply and is equal to $V_{OVPR}$. During the next cycle, the desired overdrive voltage is produced with the capacitor by closing any one of the switches 1-6.

Figure 17:
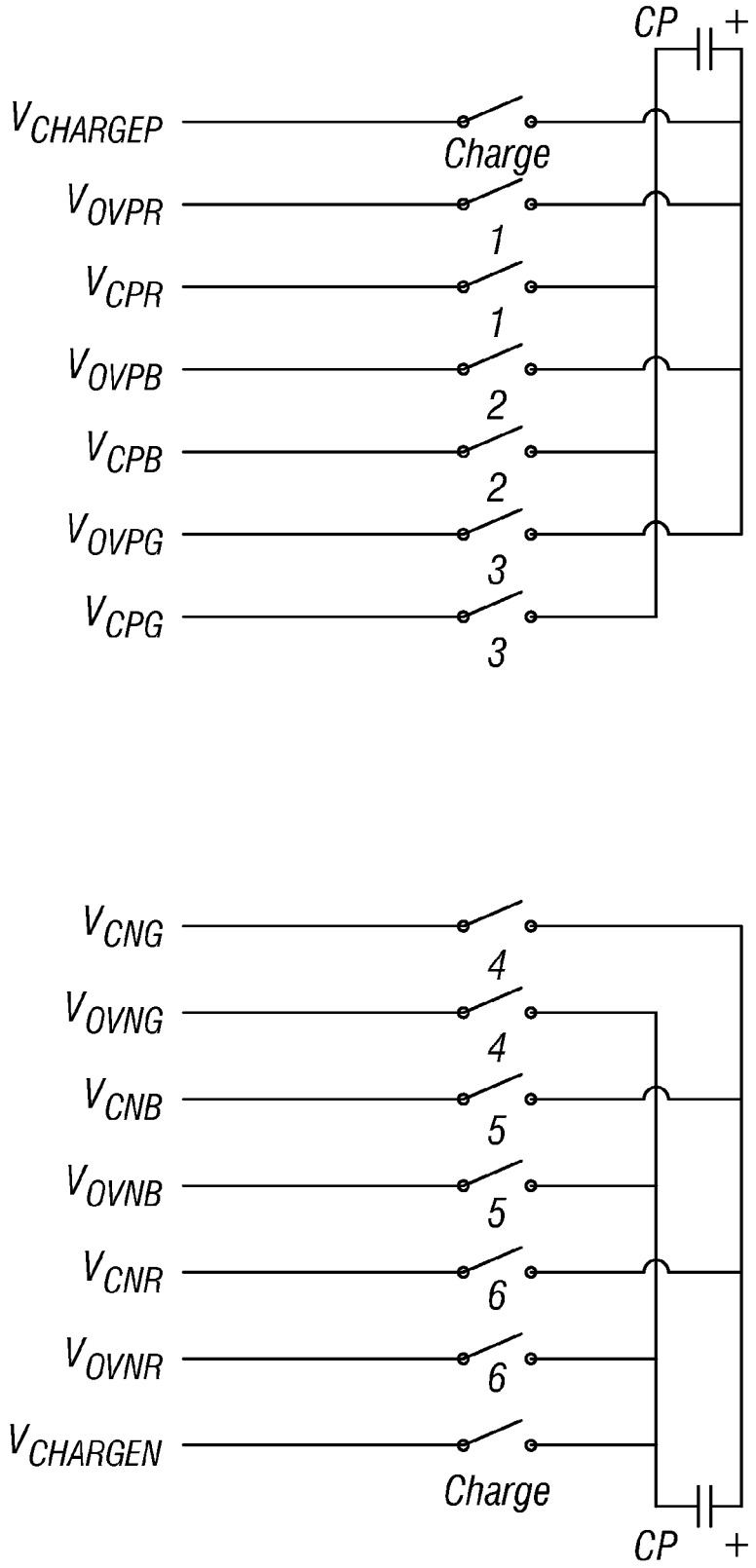
FIG. 17 illustrates a fourth embodiment of a charge pump for generating overdrive voltages.

FIG. 17 illustrates another embodiment of the charge pump illustrated in FIG. 11. In this embodiment, two additional outputs of the continuous power supply, $V_{CHARGEP}$ and $V_{CHARGEN}$, are generated and used, one for each polarity. The circuit operates in the same way as the embodiment of FIG. 16, but the positive and negative sections can be controlled independently. In this embodiment, $V_{CHARGEP}$ and $V_{CHARGEN}$ are equal to $V_{OVPR}$ and $V_{OVNR}$ respectively.

Various combinations of the above embodiments and methods discussed above are contemplated. In particular, although the above embodiments are primarily directed to embodiments in which interferometric modulators of particular elements are arranged along common lines, interferometric modulators of particular colors may instead be arranged along segment lines in other embodiments. In particular, embodiments, different values for positive and negative segment voltages may be used for specific colors, and identical hold, release and overdrive voltages may be applied along common lines. In further embodiments, when multiple colors of subpixels are located along common lines and segment lines, such as the four-color display discussed above, different values for positive and negative segment voltages may be used in conjunction with different values for hold and overdrive voltages along the common lines, so as to provide appropriate pixel voltages for each of the four colors.

It is also to be recognized that, depending on the embodiment, the acts or events of any methods described herein can be performed in other sequences, may be added, merged, or left out altogether (e.g., not all acts or events are necessary for the practice of the methods), unless the text specifically and clearly states otherwise.

While the above detailed description has shown, described, and pointed out novel features as applied to various embodiments, various omissions, substitutions, and changes in the form and details of the device of process illustrated may be made. Some forms that do not provide all of the features and benefits set forth herein may be made, and some features may be used or practiced separately from others.

What is claimed is:

1. A system for driving an array of display elements, the system comprising:

at least one capacitor;

at least one charging supply line;

a first overdrive line configured to output a positive overdrive voltage to the array of display elements;

a second overdrive line configured to output a negative overdrive voltage to the array of display elements;

a first plurality of drive lines, each configured to supply a positive drive voltage to the array of display elements;

a second plurality of drive lines, each configured to supply a negative drive voltage to the array of display elements;

a first plurality of switches configured to selectively couple the at least one charging supply line to the at least one capacitor;

a second plurality of switches, wherein each of the second plurality of switches is configured to selectively couple one of the first plurality of drive lines to the at least one capacitor;

a third plurality of switches, wherein each of the third plurality of switches is configured to selectively couple one of the second plurality of drive lines to the at least one capacitor;

a fourth plurality of switches configured to selectively couple the at least one capacitor to at least one of the first and second overdrive lines;

and a controller configured to activate a first subset of the four pluralities of switches while deactivating a second subset of the four pluralities of switches, wherein the positive and negative overdrive voltage outputs are sequentially generated in a time sequence.

2. The system of claim 1, wherein the array of display elements comprises a plurality of common lines and a plurality of segment lines.

3. The system of claim 2, further comprising an array driver circuit configured to implement an array driving scheme, wherein the scheme comprises driving each of the plurality of common lines with a common voltage and driving each of the plurality of segment lines with a segment voltage.

4. The system of claim 3, wherein the common voltage comprises a drive voltage supplied on one of the first and second pluralities of drive lines and an overdrive voltage supplied on one of the first and second overdrive lines.

5. The system of claim 3, wherein the at least one charging supply line provides the segment voltage.

6. The system of claim 1, wherein different ones of the first and second pluralities of drive lines are associated with different colors.

7. The system of claim 6, wherein the colors comprise red, green and blue.

8. A method of generating an overdrive voltage for driving an array of display elements, the method comprising:

activating at least one first switch to couple a supply voltage to at least one capacitor;

deactivating the at least one first switch;

activating at least one second switch to couple a drive voltage line to a first side of the at least one capacitor;

activating at least one third switch to couple an overdrive voltage line to a second side of the at least one capacitor;

activating a first plurality of switches to couple a segment voltage to a first of two alternating capacitors, while deactivating a second plurality of switches to uncouple the segment voltage from the second of the two alternating capacitors;

deactivating a third plurality of switches to uncouple overdrive voltage lines from the first alternating capacitor while activating a fourth plurality of switches to couple the overdrive voltage lines to the second alternating capacitor; and activating at least one switch in a fifth plurality of switches to directly couple a first overdrive voltage line to one of a first plurality of drive voltage lines.

* * * * *